US006755096B2

(12) United States Patent
Schroder

(10) Patent No.: US 6,755,096 B2
(45) Date of Patent: Jun. 29, 2004

(54) IMPACT INSTRUMENT

(75) Inventor: Kurt A. Schroder, Austin, TX (US)

(73) Assignee: Board of Regents, The University of Texas System, Austin, TX (US)

( * ) Notice: Subject to any disclaimer, the term of this patent is extended or adjusted under 35 U.S.C. 154(b) by 47 days.

(21) Appl. No.: 08/951,573

(22) Filed: Oct. 16, 1997

(65) Prior Publication Data

US 2001/0029813 A1 Oct. 18, 2001

Related U.S. Application Data

(60) Provisional application No. 60/043,681, filed on Apr. 14, 1997, and provisional application No. 60/028,636, filed on Oct. 18, 1996.

(51) Int. Cl.[7] ..... B25D 1/00

(52) U.S. Cl. ..... 81/20; 81/22; 473/549; 473/520

(58) Field of Search ..... 81/20, 22; 473/318, 473/549, 520, 300

(56) References Cited

U.S. PATENT DOCUMENTS

| | | | | |
|---|---|---|---|---|
| 2,603,260 A | | 7/1952 | Floren | |
| 2,983,296 A | * | 5/1961 | Lay | 81/20 |
| 4,548,248 A | | 10/1985 | Riemann | |
| 4,609,198 A | | 9/1986 | Tarr | |
| 4,660,832 A | | 4/1987 | Shomo | |
| 4,674,324 A | | 6/1987 | Benoit | |
| 4,674,746 A | | 6/1987 | Benoit | |
| 4,738,166 A | * | 4/1988 | Yamaguchi | 81/22 |
| 4,870,868 A | | 10/1989 | Gastgeb et al. | |

(List continued on next page.)

FOREIGN PATENT DOCUMENTS

DE 28 43 640 4/1980

OTHER PUBLICATIONS

Brody, H., Article titled, "Physics of the tennis racket II: The "sweet spot"," American Journal of Physics 49, pp. 816–819 (1981).

Brody, Howard, Article titled, "The moment of inertia of a tennis racket," The Physics Teacher 23, pp. 213–216 (1985).

Kirkpatrick, Paul, Article titled, "Batting the Ball," American Journal of Physics 31, pp. 606–613 (1963).

Brody, Howard, Article titled, "Models of baseball bats," American Journal of Physics 58, pp. 756–758 (1990).

Brody, H., Article titled, "The sweet spot of a baseball bat," American Journal of Physics 54, Jul. 1986.

(List continued on next page.)

*Primary Examiner*—D. S. Meislin
(74) *Attorney, Agent, or Firm*—Meyertons, Hood, Kivlin, Kowert & Goetzel, P.C.; Eric B. Meyertons

(57) ABSTRACT

An impact instrument for delivering an impulse to an object. The impact instrument may include an impact surface for contacting the object and an elongated member extending from the impact surface that terminates in an end. The elongated member may include a grasping region in the vicinity of the end. When the instrument is grasped within the grasping region, the center of percussion of the instrument preferably coincides with the impact surface. The instrument may also contain a pivoting grasping member disposed on the elongated member. A cavity is preferably formed between the grasping member and the elongated member and may contain compressible material. The grasping member may rigidly contact the elongated member at an ideal pivot point. The grasping member is preferably adapted to pivot with respect to the elongated member at the ideal pivot point. The pivoting of the grasping member preferably increases the amount of impulse delivered to an object, decreases vibration experienced by the user of the instrument, and reduces counter-rotational forces imparted from the instrument to the user. The impact instrument may be a hammer, ax, golf club, tennis racket, or similar device.

132 Claims, 19 Drawing Sheets

U.S. PATENT DOCUMENTS

| | | | | | |
|---|---|---|---|---|---|
| 5,094,101 | A | | 3/1992 | Chastonay | |
| 5,160,139 | A | | 11/1992 | Soong | |
| 5,193,246 | A | | 3/1993 | Huang | |
| 5,259,274 | A | | 11/1993 | Hreha | |
| 5,277,059 | A | | 1/1994 | Chastonay | |
| 5,280,739 | A | * | 1/1994 | Liou | 81/22 |
| 5,289,742 | A | | 3/1994 | Vaughan, Jr. | |
| 5,294,119 | A | | 3/1994 | Vincent et al. | |
| 5,316,299 | A | | 5/1994 | Feche et al. | |
| 5,355,552 | A | * | 10/1994 | Huang | 473/300 |
| 5,362,046 | A | | 11/1994 | Sims | |
| 5,372,053 | A | | 12/1994 | Lee | |
| 5,375,487 | A | | 12/1994 | Zimmerman | |
| 5,417,108 | A | | 5/1995 | Chastonay | |
| 5,467,984 | A | | 11/1995 | Veux et al. | |
| 5,569,097 | A | | 10/1996 | Veux et al. | |
| 5,651,545 | A | | 7/1997 | Nashif et al. | |
| 5,655,975 | A | | 8/1997 | Nashif | |
| 5,655,980 | A | | 8/1997 | Nashif et al. | |
| 5,704,259 | A | | 1/1998 | Riehle | |
| 5,845,364 | A | | 12/1998 | Chen | |

OTHER PUBLICATIONS

Brody, H., Article titled, "Physics of the tennis racket," American Journal of Physics 47, pp. 482–487 (1979).

International Search Report for PCT/US 97/18661 dated Apr. 14, 1998.

Welsh, J., Article titled, "Age–Old Task: Making a Better Hammer," Wall Street Journal, Jun. 19, 1996.

French, A.P., *Newtonian Mechanics*, 1971, WW Norton, New York, NY, pp. 659–663, 668–671.

Ron Baird and Dan Comerford, *The Hammer; the King of Tools*, Ron Baird and Dan Comerford Publishers, Columbia, Mo, 1989, pp. 1–352.

* cited by examiner

IMPACT INSTRUMENT

This application claims the benefit of U.S. Provisional Application No. 60/028,636 entitled "Improved Hammering Device," filed Oct. 18, 1996, and U.S. Provisional Application No. 60/043,681 entitled "Improved Hammering Device," filed Apr. 14, 1997.

BACKGROUND OF THE INVENTION

1. Field of the Invention

The present invention generally relates to impact instruments including hammering devices such as claw hammers, ball-pein hammers, axes, hatchets, sledges, and the like, and also including recreational devices such as croquet rackets, badminton racquets, tennis racquets, racquetball racquets, golf clubs, baseball bats, softball bats, cricket bats, hockey sticks, and the like. An embodiment of the invention relates to an impact instrument having an improved mass distribution. Another embodiment relates to an impact instrument that includes a handle that focuses the contact of the hand onto a more limited region. Another embodiment relates to an impact instrument that includes a pivoting handle. Yet another embodiment relates to an impact instrument having a handle that dampens and/or decreases shock and vibration. These embodiments may be used independently or in combination to increase the peak impulse produced by the impact instrument and/or to decrease or dampen shock/vibrational forces felt by a user of the instrument.

2. Description of the Related Art

FIG. 1 illustrates a conventional hammer 10 that includes a head 12 and a shank 14 extending from the head. The head terminates at one end in an impact surface 18 through which the hammer delivers an impulse during use. An actual pivot point 16 exists on the shank about which the hammer is pivoted or rotated in the hand during use. Hammers are typically grasped in a user's hand(s) during use and so pivot point 16 may actually be an extended pivot (i.e., a pivot region) rather than a point pivot, since the hammer pivots about a region of finite width (i.e., a hand). Nevertheless the center of this extended pivot region is generally the pivot point 16. When the hammer is grasped in the hand, pivot point 16 may be approximated to lie at a point along the shaft that is proximate the center of the middle finger of the hand. Obviously the pivot point 16 varies depending on where the hand is grasping the shank 14.

The center of impact surface 18 is separated from pivot point 16 by a vertical distance d as illustrated in FIG. 1. The center of percussion is located at a distance b from pivot point 16. The center of percussion is the point at which an impulse could be applied in a direction perpendicular to shank 14, thereby causing shank 14 to pivot about a point, such that there is minimal (in a real world application) or no force (ideally) that is perpendicular to the longitudinal axis of the shank. It should be noted that the center of percussion is not necessarily the same as the center of mass. In most objects the center of percussion is not the same as the center of mass.

The radius of gyration is separated from the actual pivot point by a distance k. The radius of gyration, k, is the distance from the actual pivot point to a location at which the mass of the hammer could be concentrated without altering the rotational inertia of the hammer about the actual pivot point. The locations of the radius of gyration and the center of percussion both depend upon the actual pivot point and the mass distribution of the hammering device. The moment of inertia, I, the radius of gyration, k, and the mass of the hammering device, m, are related by the following equation: $I=m\cdot k^2$. The center of mass of the hammer is located at a vertical distance h from pivot point 16.

The "ideal pivot point" is defined as follows for the purposes of this application. It is believed that distance b will always be equal to $k^2$ divided by h (i.e., $k^2/h$). Thus the "ideal pivot point" is when b, as calculated by the equation $b=k^2/h$, is equal to d. Stated another way, for an impact instrument the ideal pivot point is the pivot point where the center of percussion coincides with the center of the impact surface. In most cases, the "ideal pivot point" 20 exists at a location (e.g., on an elongated member) where an impulse could be applied in a direction perpendicular to the elongated member, thereby causing the elongated member to pivot about a point, such that there is no reactive force that is perpendicular to the longitudinal axis of the elongated member at that point.

Conventional impact instruments (e.g., hammers) tend to have an ideal pivot point that does not coincide with pivot point 16 when held by the typical user. That is, during normal use the center of percussion does not typically coincide with the center of the impact surface of a conventional impact instrument (e.g., hammer), which tends to make use of the impact instrument (e.g., hammer) inefficient and uncomfortable. The amount of vibration felt by the user tends to increase as the vertical distance between the actual pivot point and the ideal pivot point increases. In most conventional hammers, for instance, the ideal pivot point is often displaced from the actual pivot point in a direction toward head 12. For hammers that weigh about 1–2 pounds, the ideal pivot point is frequently between about 0.3 cm and about 3.0 cm removed from the actual pivot point.

During use of a hammering device, it is generally desirable to grasp the hammer at a location such that at least a portion of the hand is proximate or at least in the vicinity of the end 17 of the hammer as shown in FIG. 1. Grasping the hammer proximate the end allows the user to impart a given impulse to a target object with relatively less effort than if the hammer is grasped at a location that is higher up on the shank in a direction towards the head. If the hammer were grasped at the ideal pivot point of a conventional hammer, the "moment length" between the hand and the impact surface would be shortened, tending to result in more inefficient use of the hammer.

It is desirable that an improved impact instrument be derived to deliver a greater impulse and reduce vibration and shock imparted to the user of the device.

U.S. Pat. No. 4,870,868 relates to a sensing device that produces a response when the point of impact between an object and a member occurs at a preselected location on the member.

U.S. Pat. No. 5,289,742 to Vaughan relates to a shock-absorbing device for a claw hammer to dampen vibrations occurring through a steel hammer head.

U.S. Pat. No. 5,375,487 to Zimmerman relates to a maul assembly having a maul head with an annular body that is partially filled with a quantity of flowable inertia material.

U.S. Pat. No. 5,259,274 to Hreha relates to an internally reinforced jacketed handle for a hand tool.

U.S. Pat. No. 5,362,046 to Sims relates to vibration damping devices placed in the butt end of implements which are subject to impact.

The above-mentioned patents are incorporated herein by reference.

SUMMARY OF THE INVENTION

In accordance with the present invention, an impact instrument is provided that generally eliminates or reduces the aforementioned disadvantages of conventional impact instruments.

An embodiment of the invention relates to a hammering device that includes a head and a shank extending from the head. The head has an impact surface adapted to deliver an impulse to an object during use. The shank may terminate opposite the head in an end and preferably includes a grasping region in the vicinity of the end. The mass distribution throughout the hammering device is preferably such that when the hammering device is grasped within the grasping region during use, the center of percussion of the device coincides with the impact surface. An impact point is preferably centrally-disposed on the impact surface, and the center of percussion preferably coincides with the impact point during use.

Another embodiment of the invention relates to an impact instrument that includes an impact surface for delivering an impulse to an object. A shank or elongated member extends from the head and may extend substantially along a longitudinal axis. The impact instrument preferably includes a sheath substantially surrounding a portion of the shank. A cavity that contains compressible material is preferably formed between the sheath and the shank. When an object is struck with the impact surface, the shank may compress a portion of the compressible material, allowing the sheath to pivot with respect to the longitudinal axis of the shank. The sheath may lie along an axis that is substantially parallel to the longitudinal axis of the shank when the impact instrument is at rest.

The ideal pivot point is usually located at some point on the shank. During use of the instrument, the pivoting of the grasping member (e.g., a sheath) may cause the axis of the grasping member to form an angle with the longitudinal axis of the shank. The pivoting of the grasping member preferably occurs about the pivot point such that the formed angle has a vertex at the ideal pivot point and is less than about 10°. The pivoting of the grasping member preferably increases the impulse delivered to the object and decreases vibration and shock imparted to the user. The compressible material preferably dampens any vibrational forces, further reducing vibration felt by the user. The pivoting of the grasping member may also allow the rotational motion of the hand to continue at the moment of impact to reduce counter-rotational forces, shock, and stress imparted from the hammering device to the user.

The grasping member may surround the shank to form a substantially annular cavity where the compressible material is contained. The annular cavity may have a cross-section that is circular or non-circular. An inner member may be disposed between the compressible material and the shank. The inner member preferably surrounds the shank to form the annular cavity between the member and the sheath. The thickness of the cavity may vary along the length of the shank. The thickness of the cavity is preferably at a minimum proximate the ideal pivot point and may increase along the shank as the distance from the pivot point increases. The grasping member or sheath preferably rigidly contacts the shank solely at or in the region of the ideal pivot point. At other points along the shank, the compressible material preferably separates the grasping member (e.g., sheath) and the shank.

The compressible material may be disposed completely around the perimeter of a cross-section of the shank to allow the sheath to pivot with respect to the shank. The shank may comprise a front and a side, and the sheath may be adapted to pivot about the front of the shank to form an angle of about 3–7 degrees, and more preferably 5 degrees, between the axis of the sheath and the front of the shank. The sheath is preferably adapted to pivot about the side of the shank to form an angle of about 5 degrees between the axis of the sheath and the side of the shank.

The impact instrument may be a relatively small hand tool having a mass between about 1 pound and about 3 pounds. The impact surface and the elongated member may comprise metal, plastic, polycarbonate, graphite, wood, fiberglass, other similar materials, or a combination thereof. The hammering device may include a substantially rigid, non-pivoting butt located at the end of the shank to facilitate the pulling of nails. The impact instrument may be a hammering device (e.g., ball-pein hammer, maul, bricklayer's hammer, scaling hammer, sledge, hatchet, ax, etc.), a recreational device (e.g., croquet mallet, racquetball racket, badminton racket, tennis racket, golf club, softball bat, cricket bat, baseball bat, hockey stick, etc.), or any hand-held instrument that ordinarily is swung by a human to deliver an impulse to an object.

An advantage of the invention relates to an impact instrument having an impact surface that coincides with the center of percussion during use.

Another advantage of the invention relates to an impact instrument adapted to pivot about an ideal pivot point to increase the impulse (e.g., the peak impulse) delivered by the instrument during use.

Another advantage of the invention relates to increasing the effective moment length of a impact instrument without lengthening its elongated member to increase the total impulse delivered from the device.

Yet another advantage of the invention relates to an impact instrument adapted to pivot about an ideal pivot point to decrease vibrations and shock imparted from the instrument to the user.

Another advantage of the invention relates to a pivoting impact instrument that reduces fatigue experienced by a user of the instrument.

Still another advantage of the invention relates to a handle that dampens vibrations felt by the user through the handle.

Another advantage relates to an impact instrument that pivots to reduce reactive forces and stress exerted by the instrument on the user, thereby reducing incidents of stress disorders such as "tennis elbow."

BRIEF DESCRIPTION OF THE DRAWINGS

Further advantages of the present invention will become apparent to those skilled in the art with the benefit of the following detailed description of the preferred embodiments and upon reference to the accompanying drawings in which.

Figure 1:
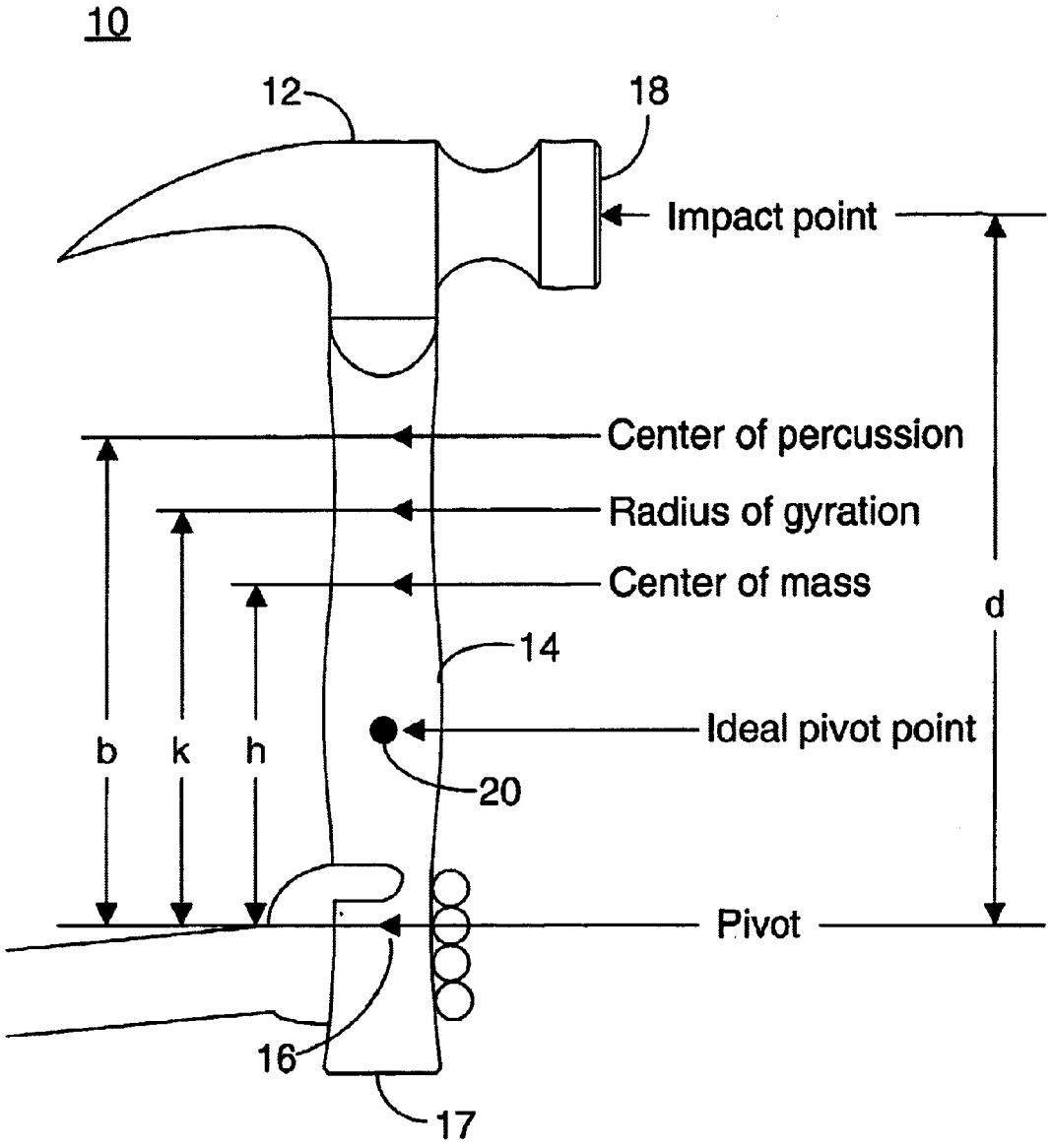
FIG. 1 (PRIOR ART)
FIG. 1 depicts a conventional hammer having an actual pivot point that is offset from the ideal pivot point.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE PREFERRED EMBODIMENTS

Figure 2:
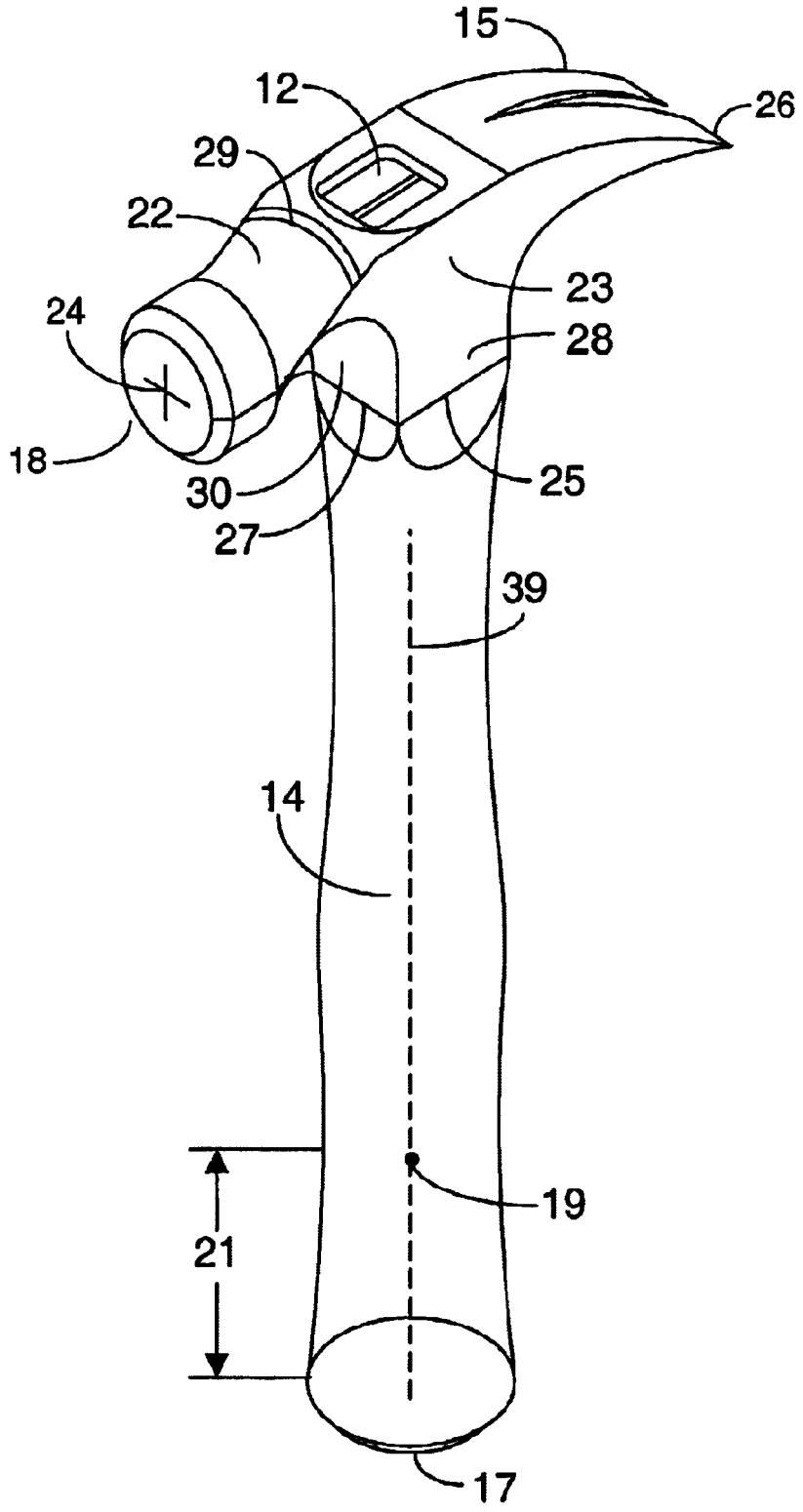
FIG. 2 illustrates various modifications that can be made to a conventional hammer design to alter the center of mass of hammer.

A claw hammer is depicted in FIG. 2. The claw hammer may include a grasping region 21 located on shank 14. The grasping region is preferably in the vicinity of end 17. The width of the shank in the grasping region may be increased or decreased relative to portions of the shank that lie outside of the grasping region. The grasping region may include one or more indentions or curved surfaces to facilitate grasping of the shank. The end 17 or butt of the hammer may be slightly wider than the remainder of the shank to inhibit the shank from slipping out of the hand during use. The grasping region preferably begins at a location on or adjacent to the butt and preferably extends upwardly (i.e., towards head 12) a vertical distance of between about 3.5 inches and about 4.5 inches, and more preferably a vertical distance between about 3.8 inches and about 4.2 inches. The grasping region preferably terminates at a location beyond which the hammer could not be grasped and used efficiently. For instance, if the shank were grasped above the grasping region during use, the reduced moment length between the hand and the hammer head would tend to measurably reduce the efficiency of hammering. The "efficiency of hammering" may be considered to be the amount of impulse or peak impulse that is deliverable by a user per unit of weight of the hammer. Throughout this description, the "hand" is taken to include the palm and all of the fingers but not the thumb. It is to be understood that the thumb may contact the shank at a point outside the grasping region to stabilize the shank during use.

It has been found that the mass of an impact instrument may be distributed to reduce the vibration experienced by a user and to increase the peak impulse that is delivered by the impact instrument. In a conventional hammer, the weight of the handle tends to cause the center of percussion to lie below the impact surface towards the shank. In many cases, the distance that the center of percussion is removed from the impact surface increases as the ratio of the weight of the shank to the weight of the head increases. Thus, assuming the same pivot point, a hammering device having a lighter (e.g., wooden) shank often tends to have a center of percussion that is closer to the impact surface as compared to a hammering device having a heavier shank made of steel, fiberglass, graphite, or another similar material. Raising the center of mass of the hammer (i.e., moving the center of mass further away from the end of the shank and closer to the head of the hammer) tends to raise the center of percussion of the hammer. In an embodiment of the invention, the mass of the impact instrument is selectively distributed to create a selected distribution of mass throughout the device such that the center of percussion coincides with the impact surface during use, and more preferably coincides with an impact point that is located in the center of the impact surface.

In an embodiment of the invention, the impact surface may be lowered towards the end of the shank relative to its position in FIG. 2 to increase the proportion of the mass of head 12 that lies above impact surface 18. The neck 22 that connects the impact surface to head base 23 may be angled or curved in a slightly downward direction (i.e., in a direction toward end 17) to bring the impact surface closer to the shank. It is preferred that the impact surface remain substantially parallel to longitudinal axis 39 of the shank, although neck 22 may lie along an axis that is perpendicular or oblique to axis 39. The impact surface may contain an impact point 24 that lies in the center of the impact surface. In an embodiment, the vertical distance (i.e., distance in the direction of axis 39) between the impact point 24 and the top of head 12 is approximately equal to the vertical distance between the impact point and the bottom 25 of head 12. In yet another embodiment, the impact surface extends downwardly towards end 17 further than the tip 26 of claw 15 that extends from the head opposite the impact surface.

In an embodiment, the width or diameter of the impact surface and/or neck may be altered to reduce or increase the mass of these portions to create a selected distribution of mass throughout the hammer. If the impact surface is positioned relatively high as compared to head base 23, the size of the impact surface and/or neck 22 may be increased to raise the center of mass of the hammer. In an embodiment, neck 22 has a width or diameter that is approximately equal to the width or diameter of the impact surface. Alternately, if the impact surface and/or neck is located low in relation to the head base, the size of the impact surface and/or neck may be decreased to adjust the mass distribution of the hammer to change the location of the center of percussion.

The degree of curvature of the claw 15 may be selected to attain a desired mass distribution and selectively locate the center of percussion of the hammer. The curvature of the claw may be reduced so that the claw terminates in a tip 26 that lies above the center of mass of the head. In an embodiment, the claw is somewhat curved and the vertical distance between end 17 and the bottom 25 of the head is less than the vertical distance between end 17 and tip 26 of the claw. The claw may be curved such that the vertical distance between end 17 and the impact surface 18 is greater than the vertical distance between end 17 and tip 26. Alternately, the claw may be substantially straight.

Increasing the "triangularity" of any portion of the head tends to redistribute mass toward the top of head 12, and thus raises the center of mass of the hammer. "Triangularity" may be taken to mean the ratio of the average width of the upper half of an object to the average width of the lower half of the object. Alternately, cavities may be placed in the head to increase the effective triangularity and move the center of percussion to the desired location. In an embodiment, the triangularity of the front 30 of the head may be increased such that the front of the head is thinnest proximate the bottom of the head. In an embodiment, the ratio of the frontal portion 29 proximate the top of the head to the frontal portion 27 proximate bottom 25 is preferably at least about 1.5, more preferably at least about 2, and more preferably still at least about 3. The triangularity of the side 28 of the head may be increased in the same manner such that the side of the head is thinnest proximate bottom 25. In another embodiment, the impact surface has a triangularity greater than 1.0 such that its top edge has a width greater than that of its bottom edge. The impact surface may have a substantially trapezoidal or triangular shape.

Various combinations of the above teachings may be used to selectively distribute mass throughout the hammer to cause the center of percussion to coincide with the impact point when the shank is grasped within the grasping region during use. For instance, for a 16 oz hammer having a shank length of about 13 inches, the mass of the hammer may be selectively distributed to cause the center of mass to be between the impact surface and the butt at a distance between about 1.8 inches and about 1.9 inches from the impact point. The center of mass of the hammering device may also be located at a point on head 12. It is to be understood that the preferred distance between the center of mass of the device and the impact surface will vary among embodiments of the invention. The preferred distance is dependent upon a number of factors including the length of the shank, the shape of the head, the weight of the hammering device, etc.

Although a claw hammer has been used above for illustration, related methods may be used to selectively place or alter (e.g., raise, lower) the center of mass and or the mass distribution of any impact instrument to cause the center of percussion and the impact surface to coincide. In a preferred embodiment, the mass distribution of the impact instrument is such that the following equation is satisfied:

$$d = \frac{k^2}{h},$$

where d is the vertical distance between an impact point on the impact surface of the instrument and an actual pivot point about which the instrument pivots during use, k is the vertical distance between radius of gyration of the instrument and the actual pivot point, and h is the distance from the actual pivot point to the center of mass of the instrument (see FIG. 1).

Most of the terms and equations used herein are based on calculations made for the "static" case. It is believed that the static case is very close to the dynamic case, and thus these calculations will still be substantially accurate for the dynamic case.

The actual pivot point 19 of relatively small hammering devices tends to be located substantially in the middle of the grasping region, approximately where a portion of a user's hand between (a) the middle of the middle finger and (b) the interface between the middle finger and the index finger would contact the shank if the shank were grasped by the hand entirely within the grasping region. In an embodiment, the actual pivot point 19 preferably is located at a vertical distance between about 2.5 inches and about 3.5 inches from the butt of the shank, more preferably between about 2.9 inches and about 3.4 inches, and more preferably still between about 3.0 inches and about 3.3 inches. The distance d preferably differs from the value of $$\frac{k^2}{h}$$

by less than about 10 percent, more preferably by less than about 5 percent, and more preferably still by less than about 2 percent.

The impact instrument preferably contains a point within the grasping region where substantially little or no reactive force is felt during use. This point is generally the ideal pivot point. It is preferred that an impact instrument have a mass distribution such that ideal pivot point coincides with the actual pivot point. That is, the ideal pivot point is preferably located about where a portion of the middle finger of the user contacts the shank during "efficient use" of the instrument. "Efficient use" is taken not to include instances in which the shank is grasped at a location high enough to reduce the moment length between the hand and the impact surface to an extent that efficiency of impulse transfer is measurably reduced. When the impact instrument is grasped such that the ideal pivot point and the actual pivot point coincide, the center of percussion will coincide with the impact surface.

It has been found that the total impulse delivered by a hammer having a center of percussion coincident with its impact surface tends to be greater than that delivered by a conventional hammer of identical weight. In addition, the characteristic time of impact is shorter and the peak impulse deliverable tends to be greater for the hammers according to the present invention as compared to conventional hammers of identical weight and length. When a nail is hammered into an object, a certain threshold force is required in order to overcome the static friction between the nail and the object in order to force the nail into the object. A force below the threshold force does not contribute to driving the nail into the surface.

Figure 8:
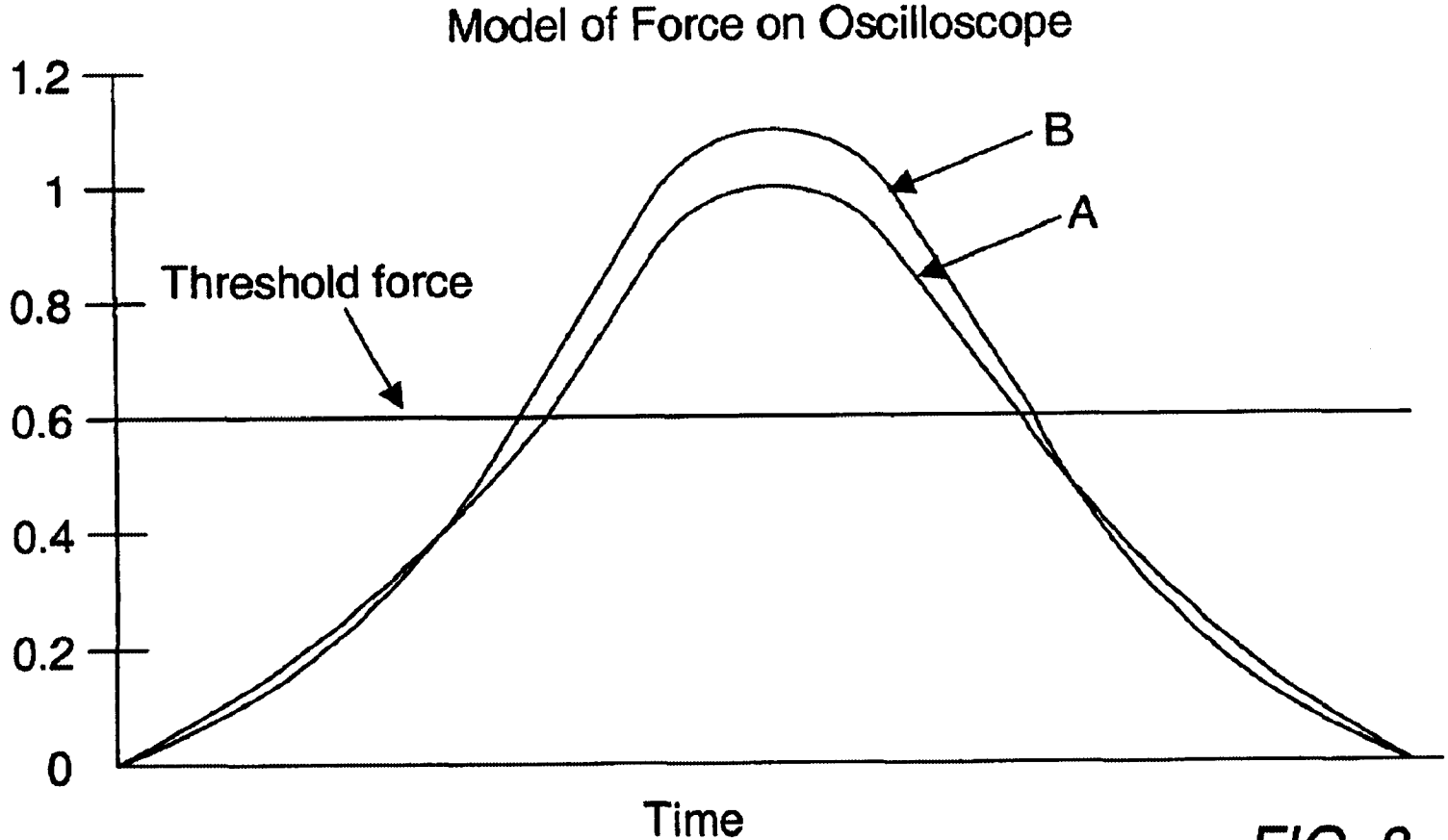
FIG. 8 depicts a graph of force imparted from an impact surface versus time for a conventional hammering device and for a hammering device constructed in accordance with the present invention.

FIG. 8 illustrates two schematic oscilloscope curves that each represent the hammering force imparted to an object versus time. The curve having the lower peak represents the force imparted to the object by a conventional hammer A. The curve having the greater peak represents the force imparted to the object by hammer B, which has a selected mass distribution such that its impact surface and center of percussion coincide. The two hammers have identical weights and the curves are corrected for any difference in moment of inertia between the hammers. The total impulse (i.e., the area under the force curve) delivered by hammer B is about 2% greater than that delivered by hammer A, however the peak force delivered by hammer B is about 10% greater than that delivered by hammer A. The force curve for hammer A exceeds that of hammer B largely at locations where the force is lower than the threshold force. Since forces lower in magnitude than the threshold force tend not to contribute to hammering a nail, the total amount of "useful" impulse transferred by hammer B tend to be at least between 2% and 10% greater than that transferred by hammer A, depending on the value of the threshold force. It is to be understood that these numbers are presented merely to illustrate the increase in peak force that may be achieved in an embodiment of the present invention. The increase in peak force delivered at impact may differ among embodiments of the invention.

Even if a hammering device is designed to be grasped about the ideal pivot point such that the center of percussion coincides with the impact point, the user likely will still experience significant vibration during use. A typical hand has a width between 3.5 inches and 4.5 inches, which disallows the hammering device to be grasped within the hand at a single point. The hand approximates an extended pivot rather than a point pivot, and most of the hand cannot be located at the ideal pivot point during use.

It has been found that a pivoting handle may cause the connection between the hand and the impact instrument to approximate a point pivot. Such a pivoting handle is preferably used in combination with the above-mentioned embodiments in which the distribution of mass is selected to cause the center of percussion of the impact instrument to coincide with the impact surface. The pivoting handle preferably rigidly contacts the shank at or proximate the ideal pivot point. Transverse vibrations (i.e., oscillations in one or more planes perpendicular to the longitudinal axis of the elongated member or shank) tend not to be felt by the user at the ideal pivot point when the impact surface contacts an object, since such vibrations may be considered to be equivalent to an "AC" torque (i.e., oscillatory torque). The pivoting handle preferably rigidly connects the hand and the shank only at the ideal pivot point, thereby reducing the vibration and shock typically experienced by the user. Shock may be considered to be a "DC" torque (i.e., a largely non-oscillatory torque) as compared to vibrational forces, The shock typically experienced by the user is preferably reduced by the pivoting action of the pivoting handle in the "primary pivot plane" (i.e., the plane defined by the swinging arc of the instrument). Vibration experienced by the user is preferably reduced by the pivoting of the handle in a direction perpendicular to the longitudinal axis of the shank. It is believed that a pivoting handle of the present invention does not eliminate shock or vibration throughout the hammering device. It preferably reduces the shock and vibration experienced by the user by creating a connection between the user and the hammering device at or proximate the ideal pivot point. It is also believed that eliminating the shock and vibration in an impact instrument is somewhat counterproductive to making an impact instrument that delivers a relatively large impulse transfer during use.

Conventional hammers typically must be grasped relatively tightly because of the shock and vibrational forces that are typically imparted to the user. Grasping the hammer in such a manner for a long period of time tends to both fatigue the user and transfer vibration to the elbow which may lead to "tennis elbow" syndrome. The reduction in shock and vibration through a pivoting handle of the present invention preferably allows the user to grasp the hammering device relatively loosely during use, reducing fatigue and repetitive stress injuries experienced by the user.

It has also been found that embodiments of the pivoting handle described herein increase the peak force and the total impulse delivered from the impact surface to an object.

Figure 3:
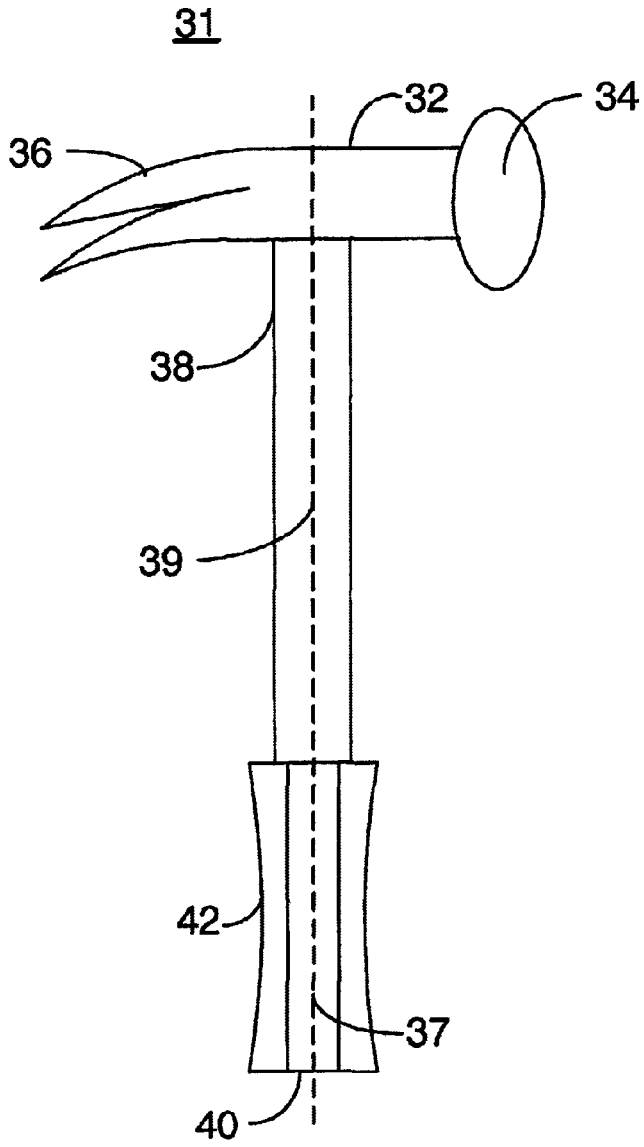
FIGS. 3 and 3A depict a hammering device having a pivoting handle in accordance with the present invention.

An embodiment of an impact instrument having a pivoting handle is illustrated in FIG. 3. Hammering device 31 may include a head 32 having a face or impact surface 34 and claws 36 that may be used for pulling hammered nails. It is to be understood that although a claw hammer is depicted in FIG. 3, the pivoting handle of the present invention is applicable to many additional hammering devices (e.g., ball-pein hammers, mauls, bricklayer's hammers, scaling hammers, sledges, axes, hatchets, etc.) and impact instruments (e.g., croquet mallets, racquetball rackets, badminton rackets, tennis rackets, golf clubs, baseball bats, softball bats, cricket bats, hockey sticks, etc.) as well. A shank 38 extends from the head along axis 39 and terminates in an end 40. The shank may include wood, metal (e.g., steel), graphite, fiberglass, hard plastic, polycarbonate, various other materials, or a combination thereof. A pivoting handle 42 is preferably provided on the shank at a selected location at least partially within the grasping region of the device.

Figure 4:
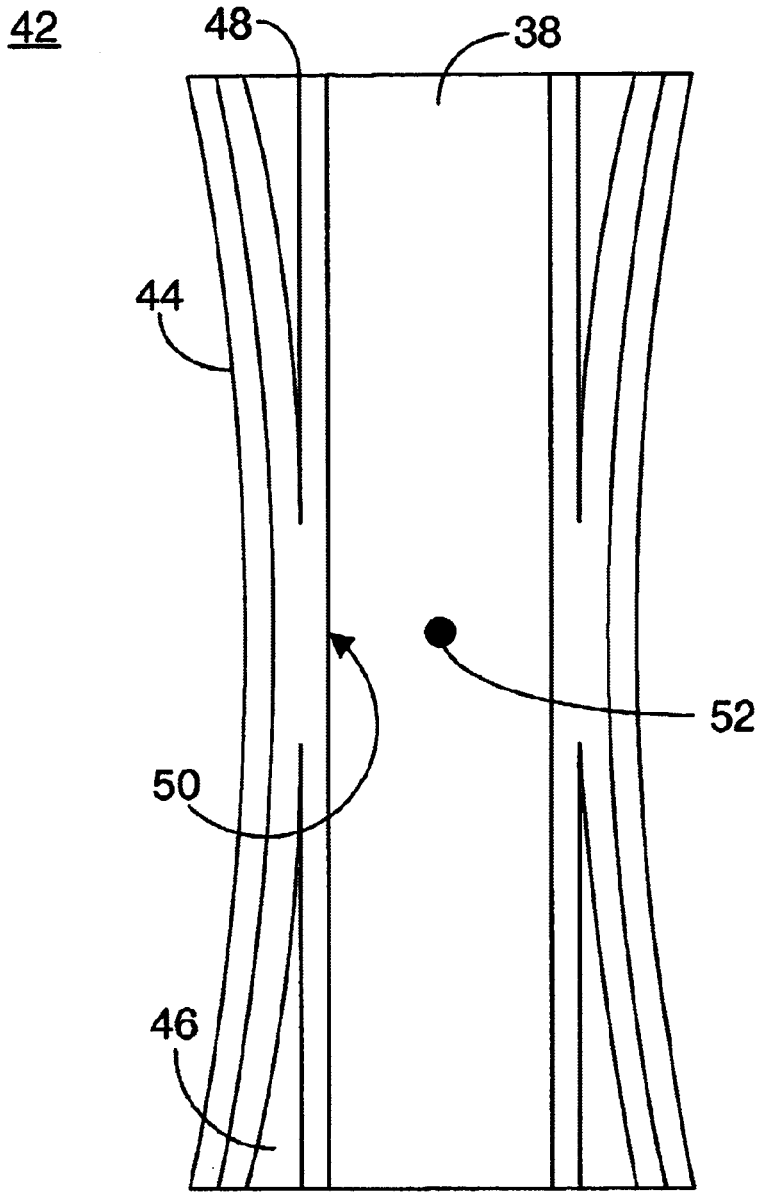
FIG. 4 depicts a pivoting handle constructed in accordance with the present invention.

An embodiment of a pivoting handle 42 is illustrated in FIG. 4. This handle may be used with any impact instrument, including hammering devices and recreational devices. The handle preferably includes an outer sheath 44 that covers at least a portion of shank 38, and preferably the sheath completely surrounds a portion of the shank. The sheath may be made of a relatively rigid, substantially incompressible material. A cavity is preferably formed between the sheath and the shank, and a compressible material 46 is preferably disposed within the cavity. The compressible material is preferably shock-dampening and may include a foam (e.g., closed-cell foam) or another similar material. The pivoting handle may include an inner member 48 disposed between the shank and the compressible material such that the compressible material is contained between the outer surface of the sheath and the inner member, allowing pivoting handle 42 to be slid onto or off of the shank. In an alternate embodiment, the cavity formed between the sheath and the shank contains no compressible material and is filled with a gas (e.g., air) that may be pressurized or unpressurized.

The cavity formed between the sheath and the shank preferably has a thickness that varies along the length of the shank. The thickness of the cavity preferably has a minimum value at a location proximate ideal pivot point 52. In an embodiment, the thickness of the cavity preferably has a minimum value proximate the ideal pivot point and the thickness increases as a quadratic function in a direction away from the ideal pivot point. The cavity preferably terminates proximate the ideal pivot point such that a portion 50 of the sheath contacts shank 38 at the ideal pivot point. Alternatively, the sheath may contact the inner member 48 at the ideal pivot point. After the impact surface contacts an object, a portion of the compressible material 46 preferably is compressed by the shank to allow the sheath to pivot. The sheath preferably contacts the shank only at or near the ideal pivot point to allow the sheath to pivot with respect to the shank at the ideal pivot point, thereby effectively transforming the extended pivot formed by the hand to a point pivot located at the ideal pivot point.

An impact instrument such as a hammering device may be grasped at any location on the outside surface of the sheath during use with the result that the sheath pivots with respect to longitudinal axis 39 about the ideal pivot point. Thus, an impact instrument may be grasped entirely above or below the ideal pivot point during use with the sheath being adapted to pivot with respect to the longitudinal axis of the elongated member or shank at or near the ideal pivot point. The impact instrument is preferably grasped on the pivoting handle such that the actual pivot point of the hand and the ideal pivot point substantially coincide.

The compressible material 46 may serve to dampen vibrations throughout the shank and prevent contact between the shank and the shaft along the entire length of the shank except at or near the ideal pivot point. The compressible material preferably maintains the sheath somewhat rigid with respect to the shank to allow the pivot to be somewhat stiff so that it does not tend to "flop" or pivot when the impact instrument is picked up or swung. The grasping member and/or the elongated member are preferably lossy (i.e., if force is applied to these members, they preferably have some ability to rebound to their equilibrium position after the force is removed). Such lossiness of the grasping member and/or the elongated member may tend to inhibit oscillatory motions of the sheath after an object is struck, pivoting occurs, and force has been applied to such members during the pivoting action.

The degree that the sheath may pivot with respect to the shank may be limited by the compressibility of the compressible material and/or by the amount or thickness of the compressible material disposed between the sheath and the shank. The compressible material also preferably dampens the rotational motion of the hand during and after an object is impacted by the impact surface.

Figure 3A:
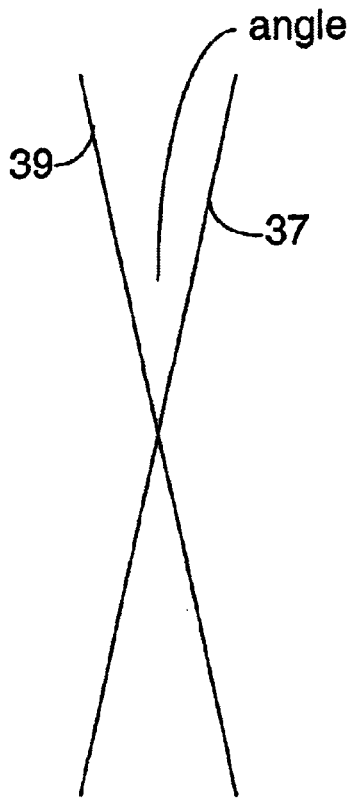

The sheath may lie along an axis 37 (shown in FIG. 3) that is parallel to and preferably coincident with longitudinal axis 39 before the impact surface contacts an object. When the sheath pivots with respect to the shank, an angle is preferably formed between axis 37 and longitudinal axis 39. The angle preferably has a vertex at the ideal pivot point and opens in a direction substantially toward the object impacted. The angle formed by the pivot may be limited by the compressible material to be less than about 10°, more preferably less than about 5°, and more preferably still between about 1° and about 3° (see FIG. 3A). The angle may also be less than 1°. The sheath preferably does not pivot with respect to the shank unless a substantial force (such as a force derived from delivering an impulse to a target object) is imparted to the impact instrument.

Figure 5:
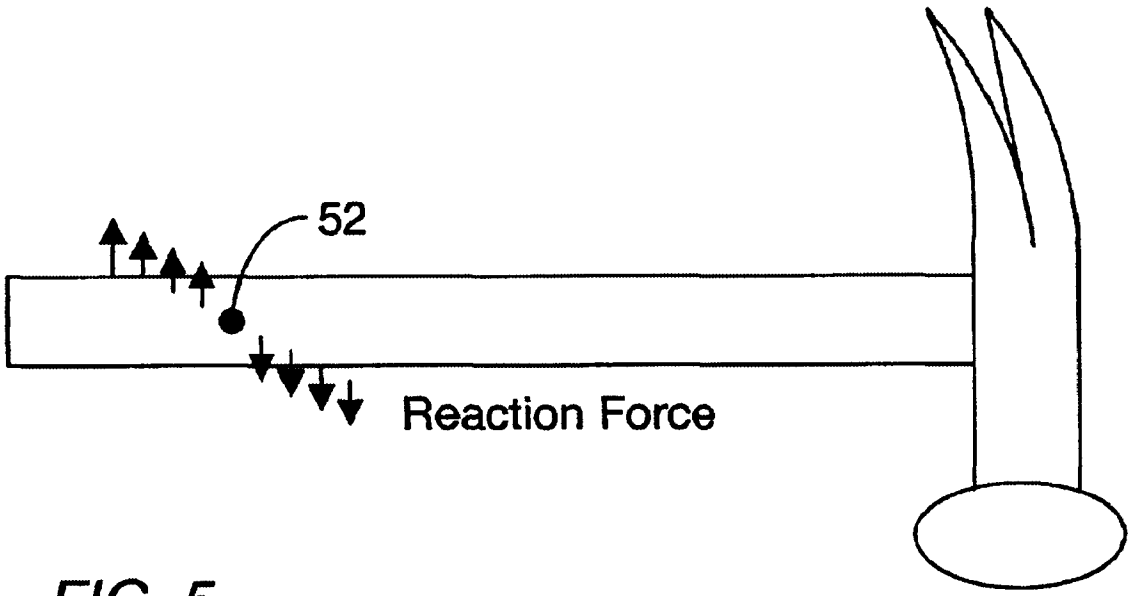
FIG. 5 depicts reaction forces imparted from the hand to the shank at the moment that an object is impacted.

The reaction forces exerted onto a shank during impact by a hand located about the ideal pivot point are illustrated in FIG. 5 for an impact instrument (e.g., for a hammer). At impact, the rigidity of the shank of a conventional hammer typically prevents the hand from continuing to rotate in the direction of the forces in FIG. 5. Since the shank tends to be relatively inflexible, the rotation of the hand is abruptly stopped at the moment of impact. Shortly after impact, the hammering device typically rotates (i.e., rebounds) in a direction opposite the direction that the hand is moving. Significant shock can be imparted to the hand at impact and shortly thereafter. The pivoting handle may reduce such stress by allowing the hand to continue rotating in the direction of the target object at the moment of impact. The hand's tendency to continue rotating during impact is impeded to a much less degree by the compressible material than it would be by a rigid, non-pivoting handle. The pivoting handle preferably rigidly connects the hand to the shank at the ideal pivot point and preferably only "loosely" connects the hand to the other locations of the shank through compressible material 46.

During impact, the hammer preferably exerts little reaction force on the hand. The compressible material preferably allows the rotation of the hand to be more gradually brought to a stop, thereby decreasing the reaction force that is exerted on the hand at impact. In this manner, the stress and fatigue that would otherwise be experienced in the wrist and/or elbow of the user are reduced. This allows the shank of the hammer to be gripped relatively loosely during use. The compressible material also preferably lessens the tendency of the user to interfere with the counter-rotational motion of the hammer after impact. The pivoting action of the hammer may shorten the time of impact and increase the peak impulse and thus the "hammering power" delivered. Such may be accomplished by reducing the degree to which the reaction force of the hand on the shank lengthens the contact time between the impact surface and the object that is impacted.

Figure 6:
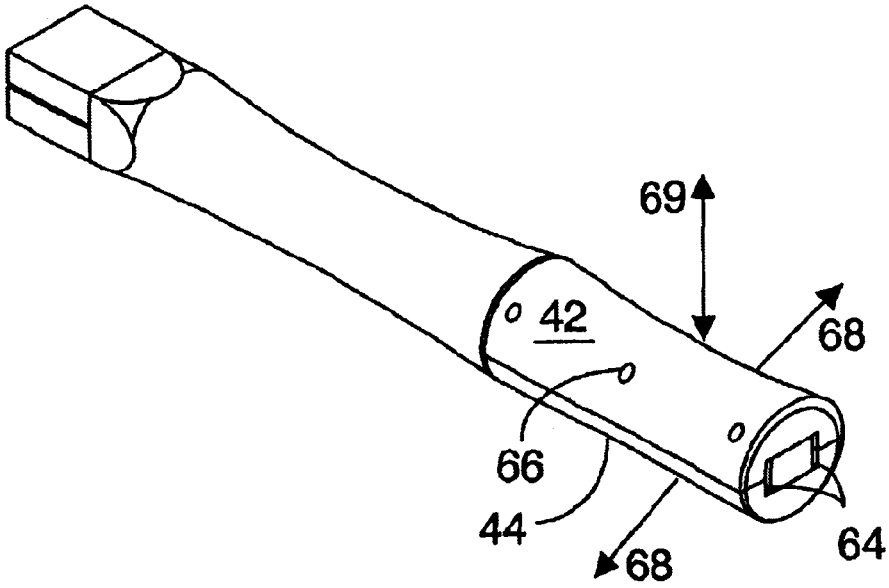
FIGS. 6 and 6A depict a pivoting handle adapted to contain compressible material partially surrounding a portion of the shank.
Figure 6A:
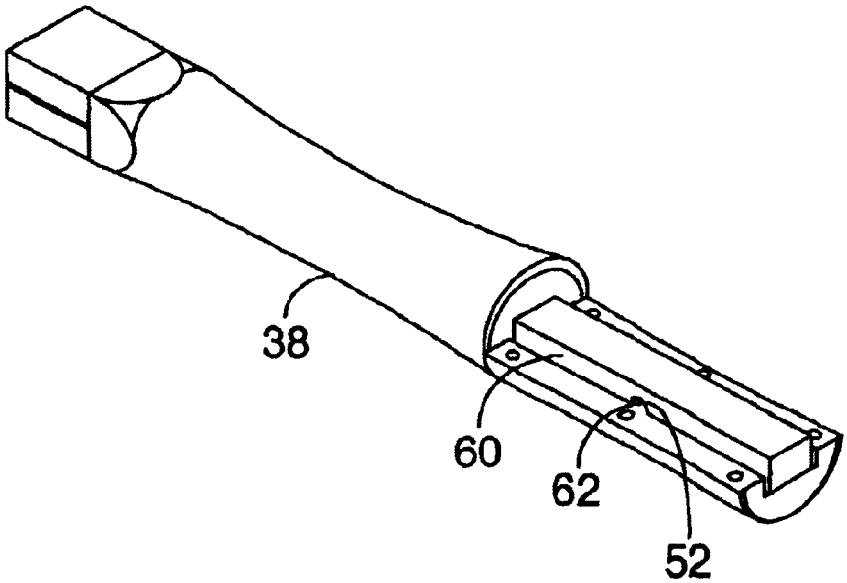

An embodiment of the pivoting handle disposed on a shank 38 is illustrated in FIGS. 6 and 6A. The pivoting handle preferably surrounds a lower portion 60 of the shank, which has a reduced width relative to the upper portion of the shank. Although lower portion 60 is illustrated having a rectangular cross-section, it is to be understood that it may have a number of other cross-sectional geometries including a circular, orthogonal, or oval cross-section. The cavity 64 formed between sheath 42 and lower portion 60 preferably has a minimum thickness proximate ideal pivot point 52. Sheath 44 may contain a protrusion 62 proximate ideal pivot point 52 that rigidly contacts lower portion 60 to cause the sheath to pivot about the ideal pivot point. Although not shown in FIGS. 6 and 6A, compressible material may be disposed about two sides of the lower portion 60 to allow the sheath to pivot "forward and backward" in the directions indicated by arrows 68 in a plane perpendicular to the impact surface. The pivoting handle may also contain a plurality of openings 66 adapted to receive a connector such as a screw for securing the top and bottom sections of the handle together.

Figures 7, 7A, 7B:
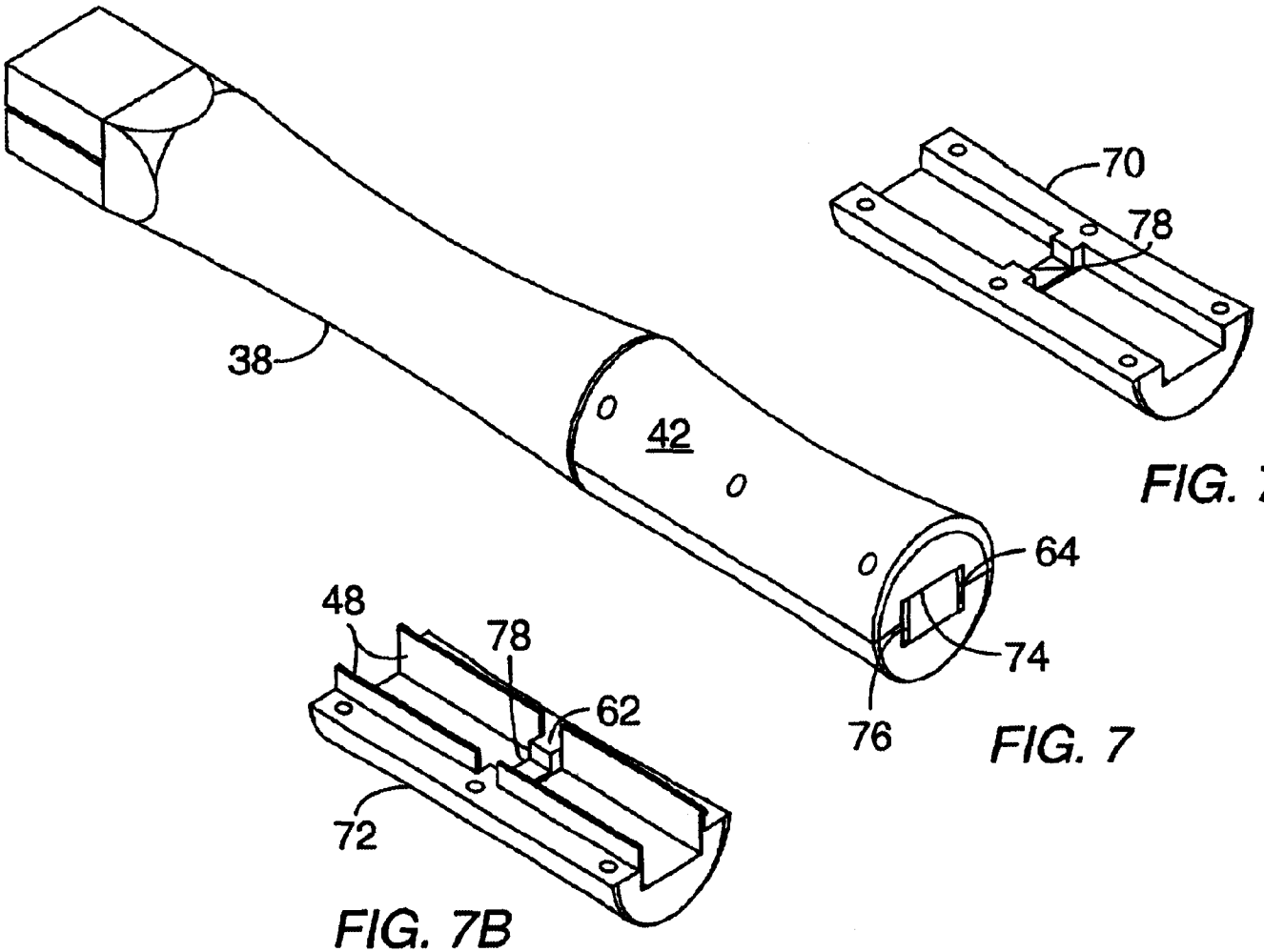
FIGS. 7, 7A and 7B depict a pivoting handle adapted to contain compressible material completely surrounding a portion of the shank.

It is preferred that the sheath also be adapted to pivot in a plane that is parallel to the impact surface during impact. The ability of the sheath to pivot with respect to the shank both "forward and backward" and "sideways" tends to reduce transverse vibrations to a greater degree as compared to an embodiment in which the sheath is limited to pivoting with respect to the shank only along a single plane. A single pivot point can reduce experienced vibration and shock in both direction 68 and direction 69 because the moment of inertia about the pivot point 52 is approximately equal in these directions. Therefore, the ideal pivot point associated with each direction has approximately the same location. The pivoting action in direction 69 largely addresses vibration, since any shock occurring in this direction tends to be relatively small in magnitude. In an embodiment illustrated in FIGS. 7, 7A, and 7B a pivoting handle 42 that includes a first section 70 and a second section 72. The sections may be disposed about the side of a lower portion of shank 38 and secured together with connectors. Cavity 64 preferably surrounds the shank such that the sheath is fully pivotable in the two dimensions perpendicular to the longitudinal axis of the shank. At a given location along the shank, the separation between the sheath and front portion 76 of the shank may be greater than the separation between the sheath and side portion 74 of the shank. Second section 72 may contain inner member 48 disposed along its length. The inner member may contain openings through which the protrusions 62 on the inner surface of the sheath extend as illustrated in FIGS. 7, 7A, and 7B. The first and second sections may also include a raised portion 78 to provide rigid contact between the sheath and the side portion 74 of the shank proximate the ideal pivot point. An endcap may be attached to the butt of the shank. The endcap may be relatively small. In a hammer the endcap is preferably relatively large to assist in the pulling of hammered nails.

In an embodiment, the sheath surrounds the shank such that the cavity formed therebetween is an annular cavity disposed about the shank. The pivoting handle may be formed from a pair of concentric tubes with compressible material disposed therebetween. The tube of greater width (e.g., diameter) may function as sheath 44 and the inside tube may function as inner member 48. The width of the sheath may vary along the length of the handle such that it has a minimum proximate the ideal pivot point on the shank and increases (preferably smoothly) in a direction away from the ideal pivot point. The reaction force exerted on the hand at impact tends to increase as the distance from the ideal pivot point increases, and the thickness of the sheath preferably varies as a function of the typical reaction force imparted from the shank to a user during use. The sheath is preferably adapted to radially pivot with respect to the shank such that it can pivot in the two dimensions perpendicular to the longitudinal axis of the shank.

Generally, it is preferred that the ideal pivot point be located in the middle of the pivoting handle (as shown in FIG. 4) such that the handle tends to be grasped about the ideal pivot point where the sheath contacts the shank. Alternately, it may be desired to add a pivoting handle to a conventional hammer without altering the mass properties of the hammer. An asymmetric pivot handle (i.e., one in which the midpoint along the length of the pivoting handle does not coincide with the ideal pivot point) may be placed onto the hammer to rigidly connect the hand to the sheath at the ideal pivot point.

Figure 9:
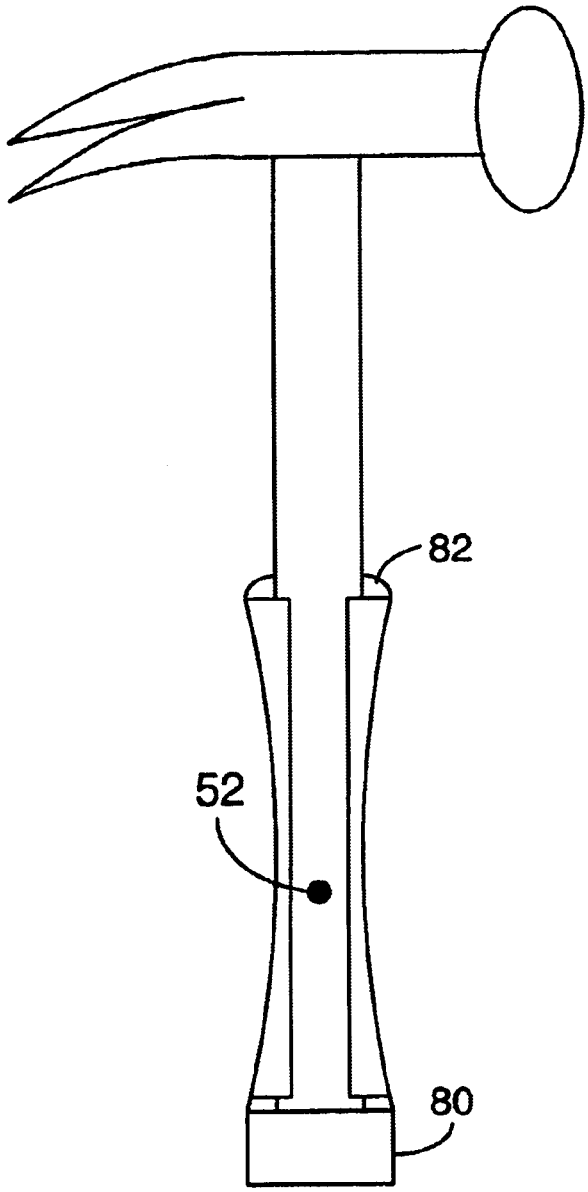
FIG. 9 depicts a hammering device having an asymmetric pivoting handle.

In an embodiment of the invention, pivoting handle 42 is placed onto a hammering device having an ideal pivot point located on the shank above the grasping region 21. FIG. 9 illustrates an asymmetric pivot hammer in which the top end of the handle is closer to the ideal pivot point than the bottom end of the handle. During use, any outer portion of the sheath may be grasped and the hand retains its rigid connection with the shank only at the ideal pivot point. The sheath can be grasped below the ideal pivot point at a location in the vicinity of the end of the hammering device so that a selected moment length exists between the actual pivot point and the impact surface. Although the sheath may be grasped below the ideal pivot point, the pivoting handle causes the sheath to pivot with respect to the shank at the ideal pivot point. In this manner, the vibration felt by the user may be reduced and the peak impulse delivered by the device may be increased. The pivoting handle preferably creates rigid contact between the sheath and the shank such that pivoting occurs about the ideal pivot point regardless of where the sheath is grasped.

Hammered nails can be pulled by positioning the nail between the claws of the hammer and applying a sudden impulse to the butt of the hammer. If a pivoting handle extends over the butt, the compressible material proximate the butt may lessen the effectiveness of the above-mentioned nail-pulling technique. In an embodiment, the hammer contains a substantially rigid, non-pivoting butt 80 (shown in FIG. 9). The pivoting handle preferably terminates short of the butt. The rigid butt may be impacted to facilitate the pulling of nails.

In an embodiment of the invention, the pivoting handle contains an elastic or flexible material 82 disposed proximate its top end. The material 82 may be rubber, plastic, or another similar material. The material 82 preferably covers the interface between the top end of the pivoting handle and the adjacent shank portion. The material 82 preferably serves to prevent the user from being "pinched" between the top end of the handle and the shank during pivoting of the sheath during impact. The material 82 may cover the entire outer surface of the pivoting handle and the butt and may extend onto the shank slightly beyond the top end of the pivoting handle.

Figure 10:
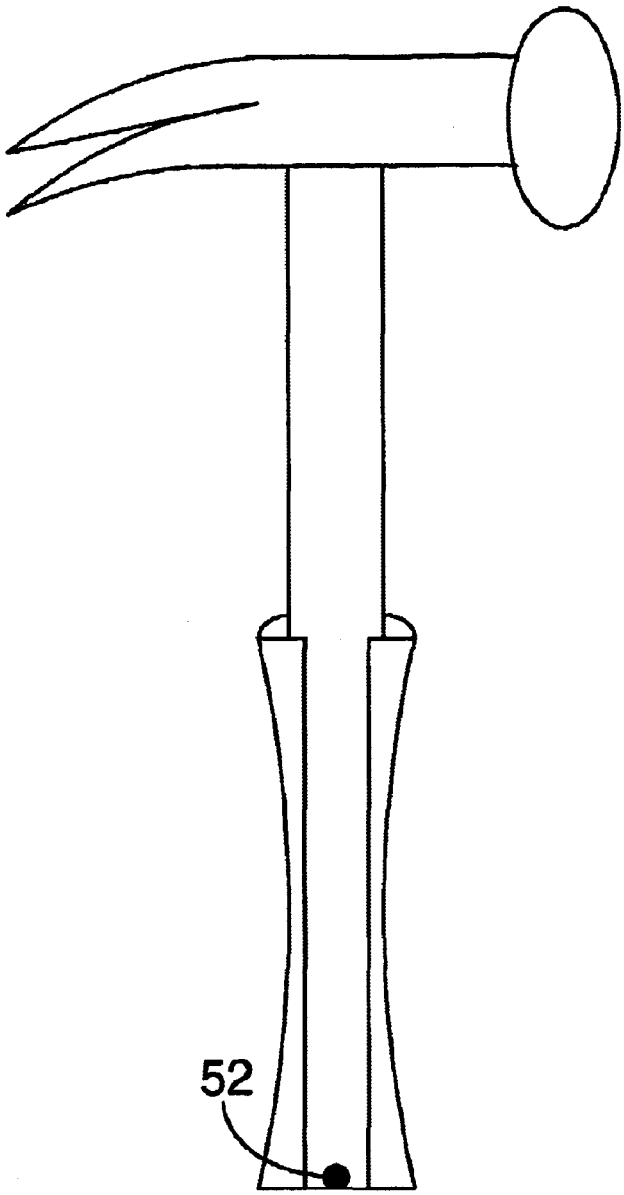
FIG. 10 depicts a hammering device having an asymmetric pivoting handle and an ideal pivot point proximate its end.

In an embodiment illustrated in FIG. 10, the hammering device has a mass distribution such that the ideal pivot point is proximate to or at the end of the shank of the hammer. A pivoting handle is preferably positioned onto the shank as shown in FIG. 16A. It is preferred that the cavity containing the compressible material has a thickness that decreases along the length of the shank toward the end of the hammering device. The cavity preferably terminates proximate the end so that the sheath contacts either the shank or inner member at the ideal pivot point. The hammer may be grasped at any location on the sheath during use, and the sheath preferably pivots with respect to the shank at the ideal pivot point. Although the hammering device may be held at a location on the sheath above the ideal pivot point during use, it is believed that the impact characteristics of the device would be equivalent to those of a hammering device having a longer handle. It is anticipated that the "effective" moment length may be increased by about at least about 10% and perhaps a substantially greater amount. For conventional, relatively small hammering devices (i.e., those with shanks having a length of less than about 14 inches), the ideal pivot point may be lowered from its usual location on the shank by a distance in excess of about 3–4 inches. The impulse delivered tends to increase by an amount proportional to the square root of the increase in the moment length. Thus, the hammering device can impart a greater impulse than a conventional hammer of identical weight and length with the same effort.

Although hammering devices have been used to exemplify the above embodiments of the present invention, it is to be understood that such embodiments are also applicable to wide range of impact instruments including but not limited to croquet mallets, racquetball rackets, badminton rackets, tennis rackets, golf clubs, baseball bats, softball bats, cricket bats, hockey sticks, mauls, sledges, axes, hatchets, etc.

Figure 11:
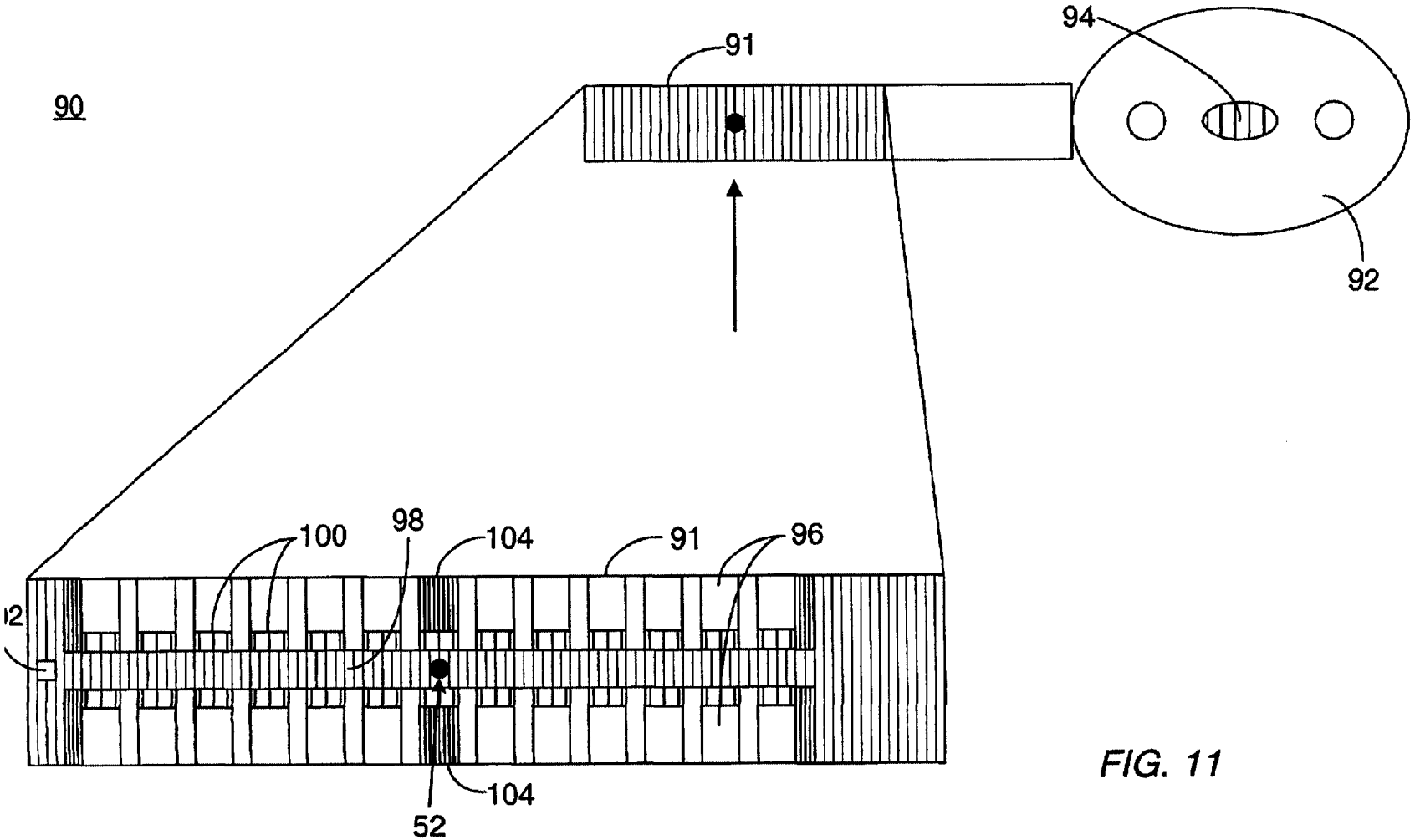
FIG. 11 depicts a racket having an adaptive pivoting handle constructed in accordance with the present invention.

An embodiment of a racket 90 having a pivoting handle 91 constructed in accordance with the present invention is depicted in FIG. 11. The racket contains an impact surface 92 and a sweet spot 94 centrally disposed on the impact surface. The pivoting handle preferably contains a plurality of pairs of bumpers 96 provided along the length of the handle. The bumpers of a given pair may contact opposite sides of the racket frame portion 98 disposed within the handle. The length of each bumper is preferably variable such that the bumpers are operable between retracted and extended positions. In the absence of a force of selected magnitude applied against the bumpers, the bumpers may tend to extend to their maximum length. The bumpers are preferably selectively retractable such that each bumper retracts a distance that is determined by the magnitude of the force exerted against it.

Each bumper preferably contains a force sensor 100 proximate its end. The force sensors may be piezoelectric transducers, strain gauges, or similar devices well known to those skilled in the art. Each force sensor preferably is adapted to determine the force exerted by the frame member against a bumper at the moment that the impact surface of the racket contacts an object. The force sensors may be adapted to send an electronic signal to a processing device 102. Each bumper pair is preferably adapted to become rigid or stiffen to maintain a constant length upon receiving an electronic signal from the processing device. The stiffening of the bumpers may be accomplished by a solenoid. The stiffening of a pair of bumpers preferably rigidly secures a portion of the frame member between the bumpers.

When the impact surface of the racket contacts an object, a torque is exerted on the frame member within the handle. It is preferred that only a single bumper pair (e.g., the bumper pair closest to the ideal pivot point when the object contacts the "sweet spot" of the impact surface) is stiff prior to impact. Forces of varying magnitudes are exerted on each of the force sensors shortly after impact. Each of the sensors may send an electronic signal to the processing device that varies as a function of the magnitude of a force sensed by the sensors. The processing device preferably compares the received signals to determine the set of bumpers that is closest to the ideal pivot point by locating the set of bumpers where the least amount of force is exerted at impact. Alternately, the processing device may determine where a "change in sign" of the force exerted along the bumpers occurs to determine the location of the ideal pivot point. The processing device may send an electronic signal to cause the set of bumpers closest to the ideal pivot point to stiffen, thereby inhibiting movement of the portion of the rod "pinched" between the stiffened bumper pair. The stiffened bumpers preferably create a pivot point about which the frame member pivots after impact. By changing the location along the handle about which the frame member pivots, the "sweet spot" can be effectively defined on the impact surface where the object contacts the impact surface.

Figure 12:
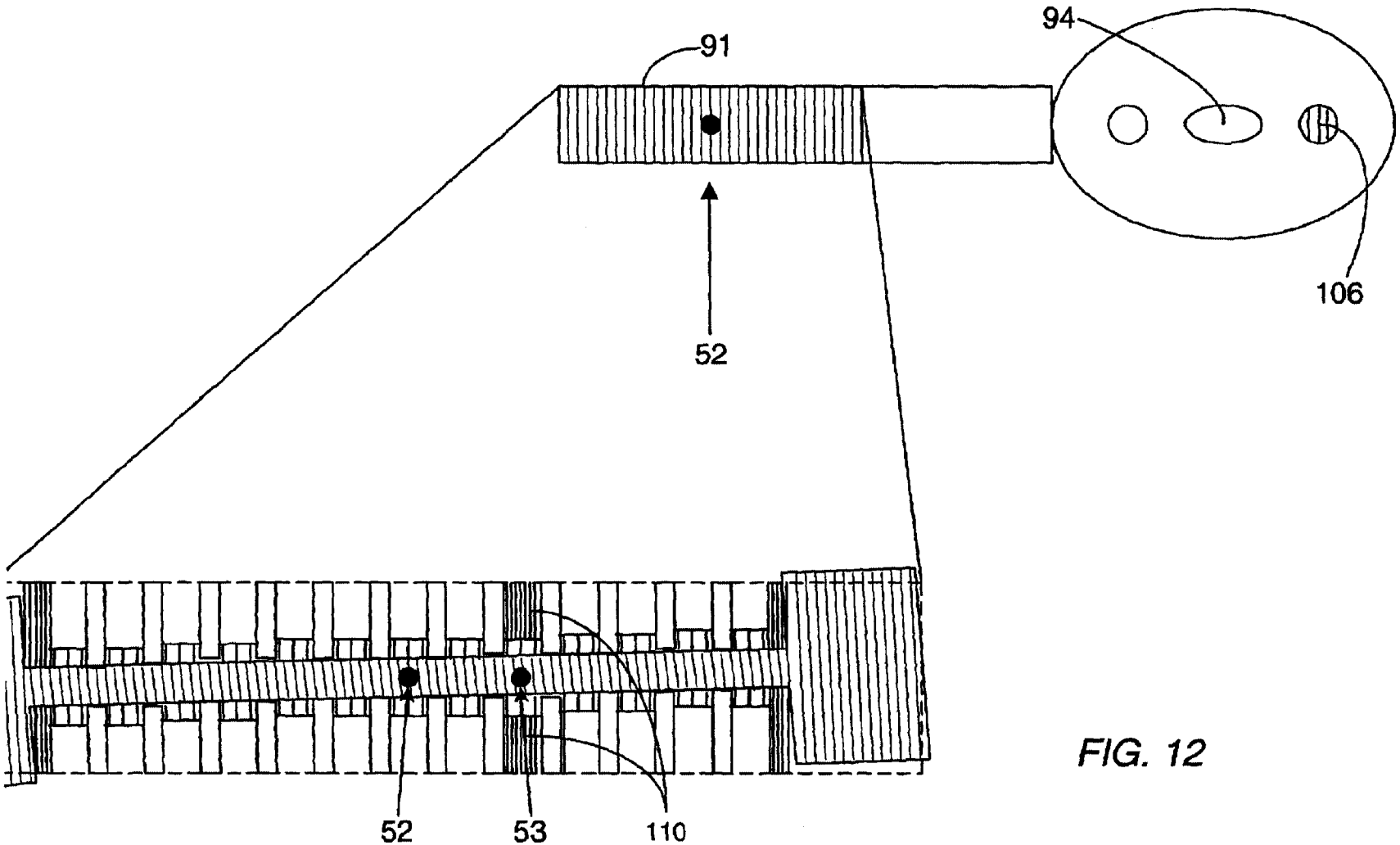
FIG. 12 depicts the pivoting handle of FIG. 12 in a pivoted position.

FIG. 11 illustrates the position of the bumpers before an object contacts the impact surface. If the object contacts the impact surface at a location proximate the sweet spot, bumpers 104 will stiffen to define the actual pivot of the handle at the ideal pivot point. FIG. 12 illustrates the position of the bumpers after an object contacts the impact surface of the racket at a location 106 beyond the sweet spot. Shortly after the object is impacted, the force sensors determine the force exerted on each bumper by the frame member, and the approximate location of the "modified" ideal pivot point 53 is determined. The processing device preferably sends a signal to the bumper pair 110 proximate the "modified" pivot point causing the bumpers to stiffen so that the pivoting handle pivots about the "modified" pivot point. In this manner, the "sweet spot" of the racket may essentially be redefined at or near the location that the object contacts the racket. Relocating the sweet spot in this manner preferably allows a greater impulse to be delivered to the object and reduces vibration felt by the user through the handle. Similar "adaptive" handles may be used for a variety of other impact instruments. The electronic signals are preferably transmitted to and from the processing device in substantially less time than the characteristic time of impact on the impact surface.

Figure 13:
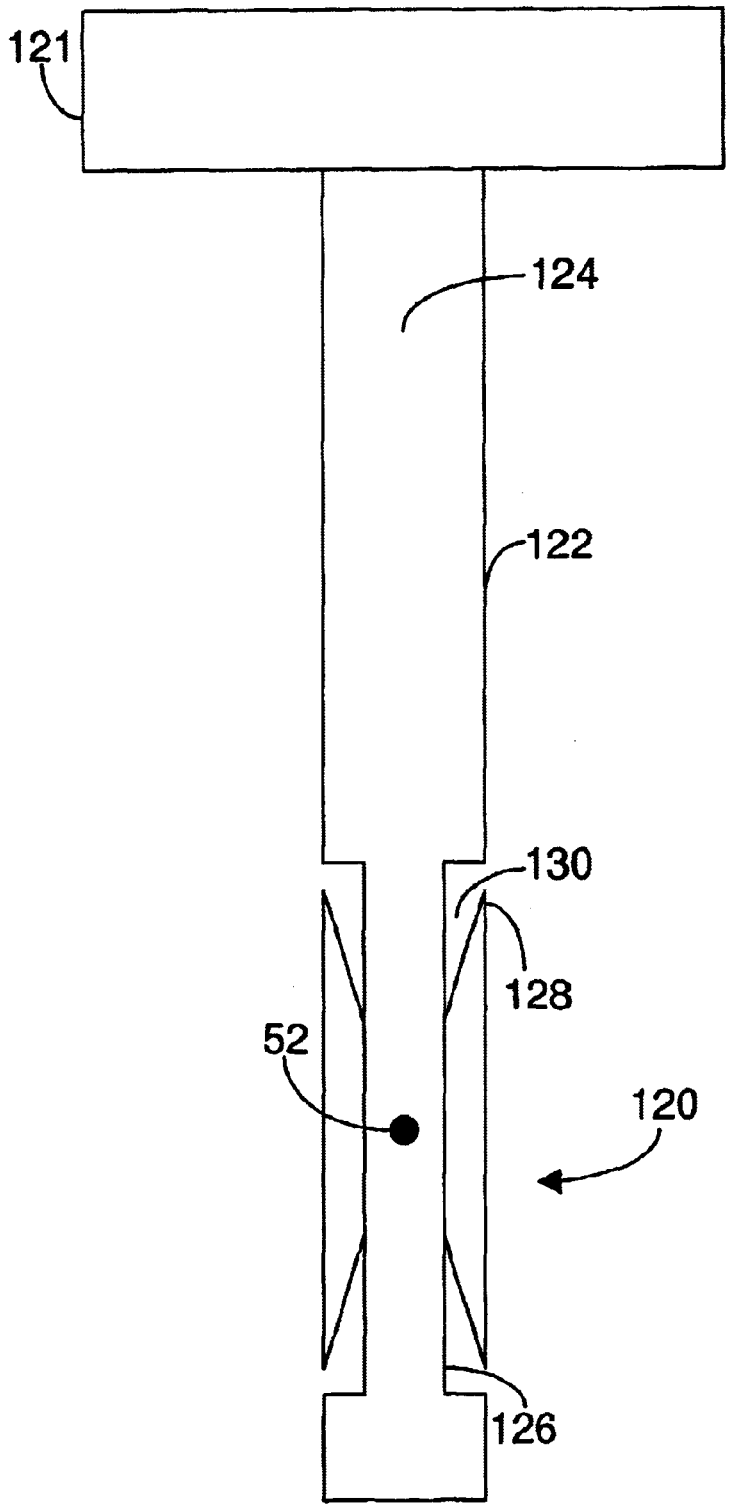
FIG. 13 depicts an impact instrument wherein the extended grasping region of the hand has been reduced to a smaller effective grasping region.

In an embodiment of the invention illustrated in FIG. 13, the impact instrument may contain an elongated member 124 and a grasping member 120 connected to the elongated member. The elongated member preferably extends from head 121 and includes an upper section 122 and a lower section 126. The lower section may have a width less than that of the upper section. The grasping member is preferably connected to the lower section at a location proximate the ideal pivot point 52 on the elongated member. The grasping member preferably surrounds the lower section, although it may include two sections disposed on opposite sides of the elongated member as shown in FIG. 13. The grasping member preferably contains an end 128 that is in spaced relation with the lower section of the elongated member to form a cavity 130 therebetween.

Grasping member 120 is preferably connected to the elongated member at a relatively small region or single location proximate the ideal pivot point. Grasping member 120 may serve to rigidly connect the hand with the elongated member at a location proximate the ideal pivot point to reduce shock or vibration experienced by the user through grasping member 120. In an embodiment, the elongated member does not pivot with respect to grasping member 120, however the grasping member reduces the amount of indirect contact between the user and locations on the elongated member where vibration and shock and vibrational forces are present (e.g., locations proximate cavity 130). In an alternate embodiment, the elongated member is adapted to pivot about the point at which the grasping member is connected to the elongated member. The cavity 130 may contain compressible material.

Figure 14:
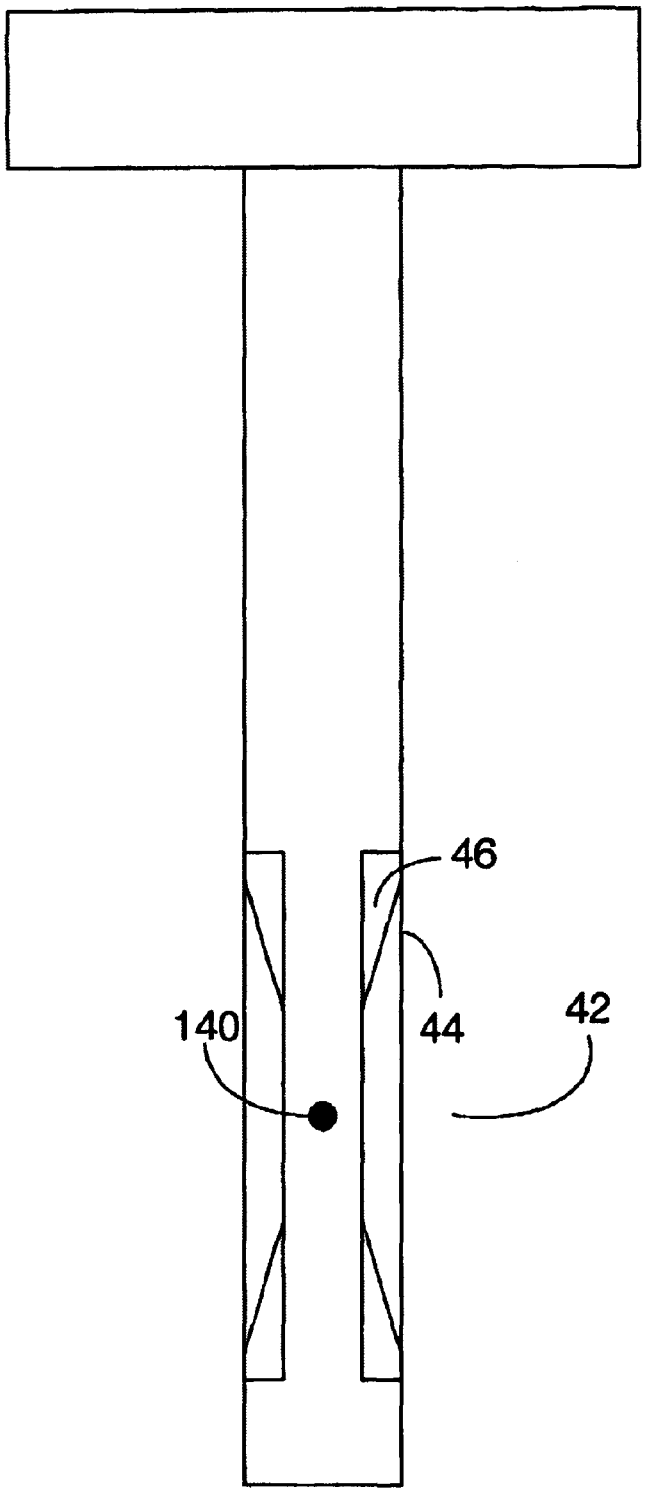
FIG. 14 depicts an impact instrument with a pin or similar device.

In an embodiment illustrated in FIG. 14, the pivoting handle 42 has an opening that contains a pin 140 or similar device. The pin preferably extends through sheath 44 and the lower portion of the shank to connect the pivoting handle to the shank. The pin preferably extends through the shank at or proximate the ideal pivot point, and the sheath is preferably adapted to pivot about the pin. The pin is preferably flush or recessed with respect to the outer surface of the sheath to prevent the pin from interfering with the user's ability to grasp the sheath about the ideal pivot point.

Figure 15:
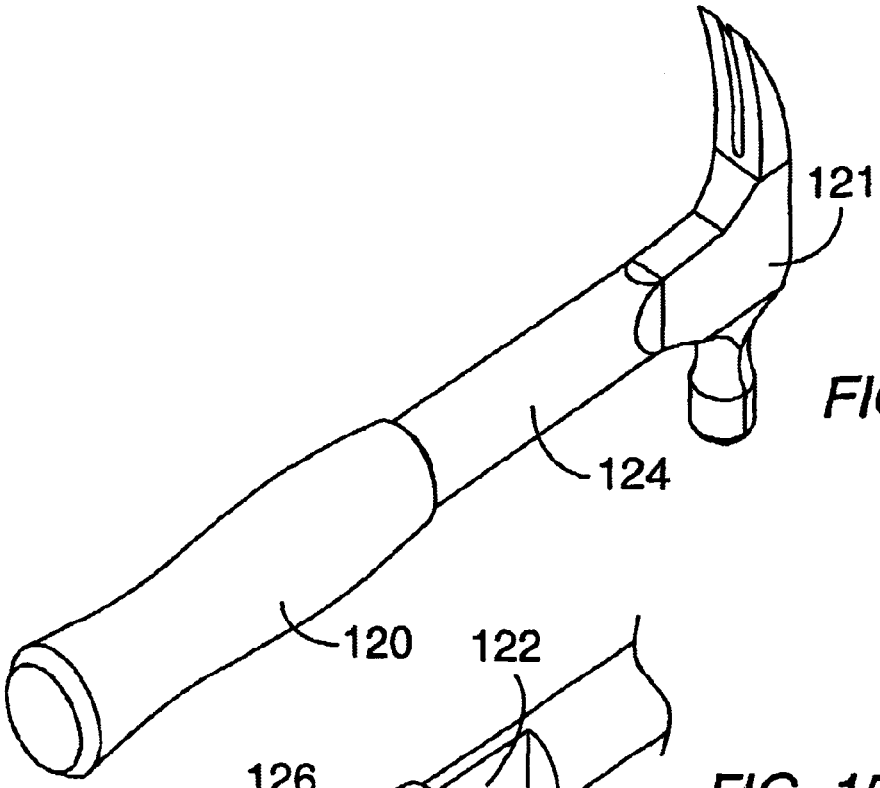
FIGS. 15, 15A and 15B depict an impact instrument with one embodiment of the grasping member.
Figure 15A:
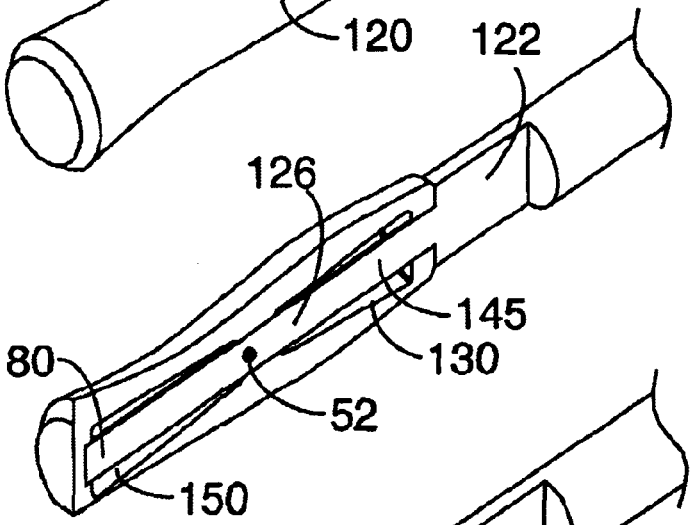
Figure 15B:
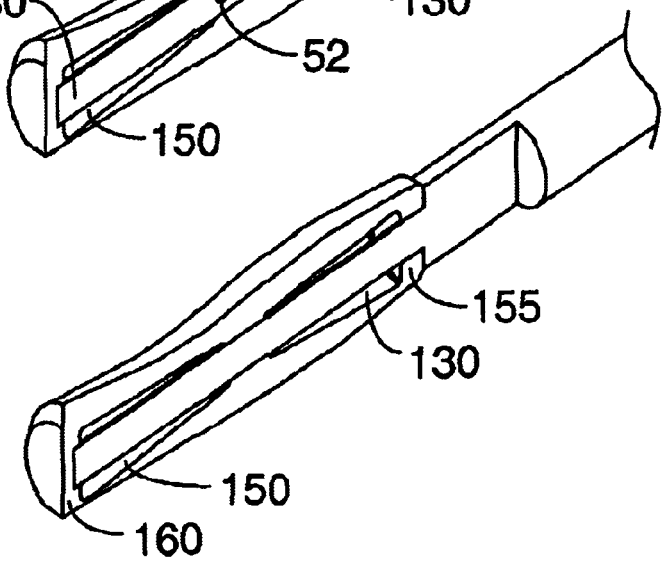

In an embodiment of the invention illustrated in FIGS. 15, 15A, and 15B the instrument may contain an elongated member 124 and a grasping member 120 connected to the elongate member. The elongate member preferably extends from head 121 and may include an upper section 122 and a lower section 126. The lower section may have a width or thickness less than that of the upper section. The grasping member is preferably connected to elongated member 124 to the lower section 126 at three locations. The grasping member is preferably connected to the lower section proximate the ideal pivot point 52. The grasping member may also be connected to the lower section proximate the butt end 80 and near the end of the grasping section proximate the border 145 between the lower section 126 and upper section 122 of the elongated member as shown in FIGS. 15, 15A, and 15B.

At least two cavities 130 and 150 are preferably formed between the grasping member and the lower section. In some embodiments only one cavity may be formed. The cavities preferably extend between the locations where the grasping member contacts the lower section. The cavities formed between the grasping member and the lower section preferably have a thickness that varies along the length of the shank. The thickness of each of the cavities preferably has a minimum near the ideal pivot point 52 and may have a maximum proximate the two ends of the lower section 126. The cavities may be filled with a compressible material. The grasping member may be made of a semi-rigid material. Upon impact, the grasping member may bend to momentarily alter the thickness of a portion of the cavities so as to form an "effective pivot" about the ideal pivot point. The only means by which shock and vibration may reach the user's hand is preferably through the ends of the grasping section 155 and 160. Since the average distance between the ends 155 and 160 and the user's hand is generally several times greater than the average closest distance between the lower section and the user's hand (as in a typical hammer), little shock or vibration is felt. Furthermore, power is generally coupled to the user through the ends 155 and 160. This further reduces the shock and vibration felt by the user. Although different in form, this embodiment is nearly identical in function and possesses the advantages of an actual pivot embodiment in a more practical form.

In another embodiment, the regions of the grasping member 160 and 155 that contact the lower portion of the elongated member at ends 80 and 145, respectively, may be made of a compressible material. This further allows an "effective pivot" at the ideal pivot point 52.

Figure 16:
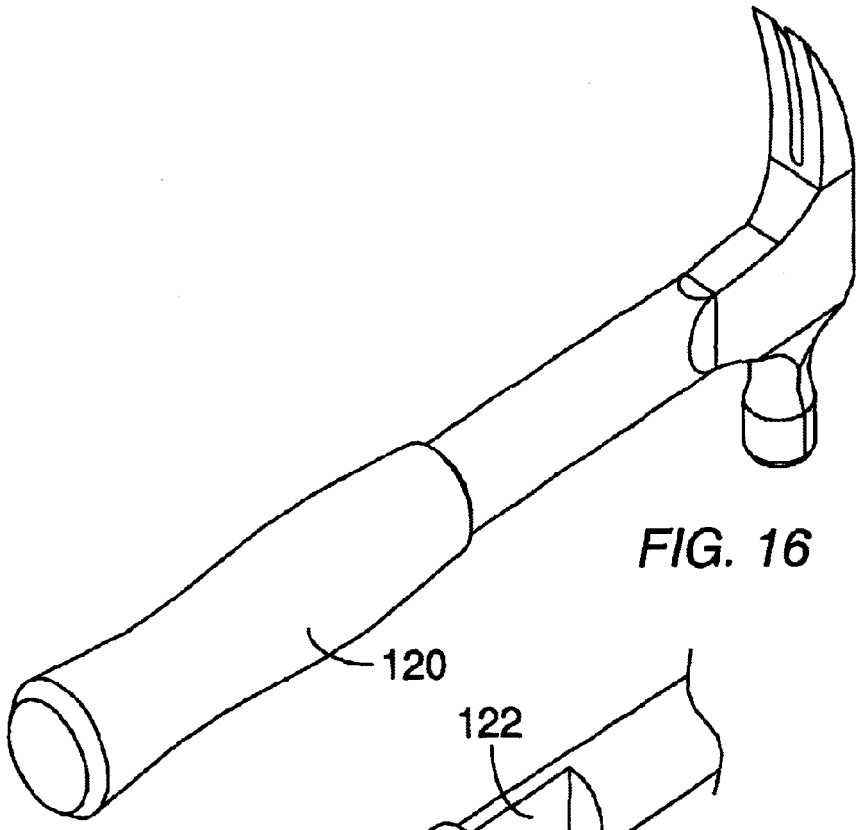
FIGS. 16, 16A and 16B depict an impact instrument with another embodiment of the grasping member.
Figure 16A:
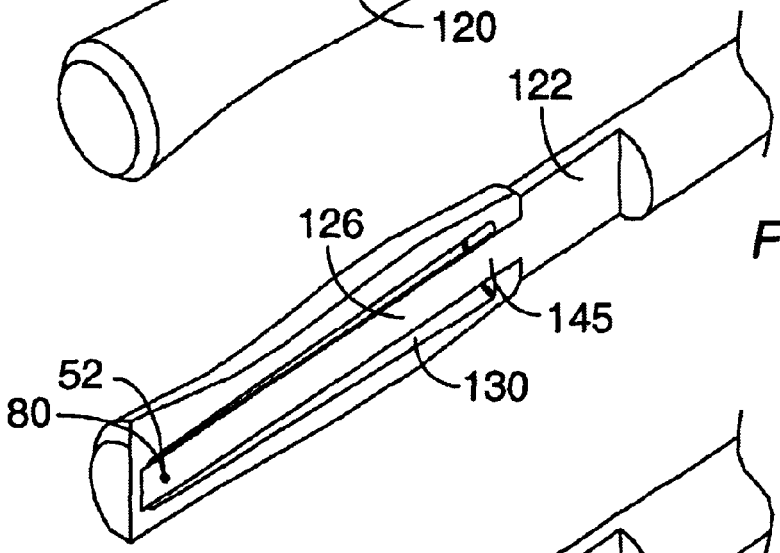
Figure 16B:
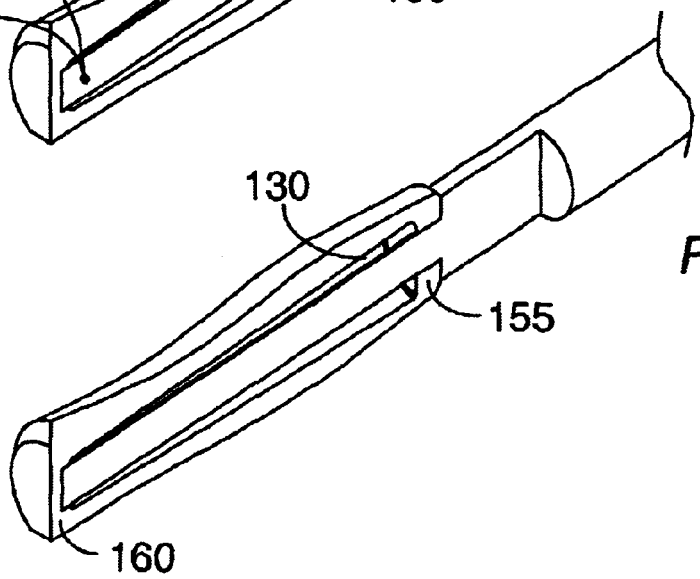

In an embodiment illustrated in FIGS. 16, 16A, and 16B the mass properties of an impact instrument such as a hammer are such that the ideal pivot point 52 is proximate the butt end of the hammer 80. Here, the grasping member 120 is connected to the lower section 126 at two locations 80 and 145, corresponding to the butt of the hammer and the end of the grasping section proximate the border 145 between the lower section 126 and upper section 122 of the elongated member, respectively. A cavity 130 is formed between the grasping member and the lower section and between the ends of the grasping region 155 and 160. The cavity formed between the grasping member and the lower section preferably has a thickness that varies along the length of the shank. The thickness of the cavity preferably has a minimum near the ideal pivot point 52 and may have a maximum proximate end 145. The cavity may be filled with a compressible material. The grasping member may be made of a semi-rigid material. Upon impact, the grasping member may bend to momentarily alter the thickness of a portion of the cavity so as to form an "effective pivot" about the ideal pivot point.

In an embodiment, the regions of the grasping member 155, which contact the lower portion 126 of the elongated member may be composed of a compressible material. This further allows an "effective pivot" at the ideal pivot point 52.

Figure 21:
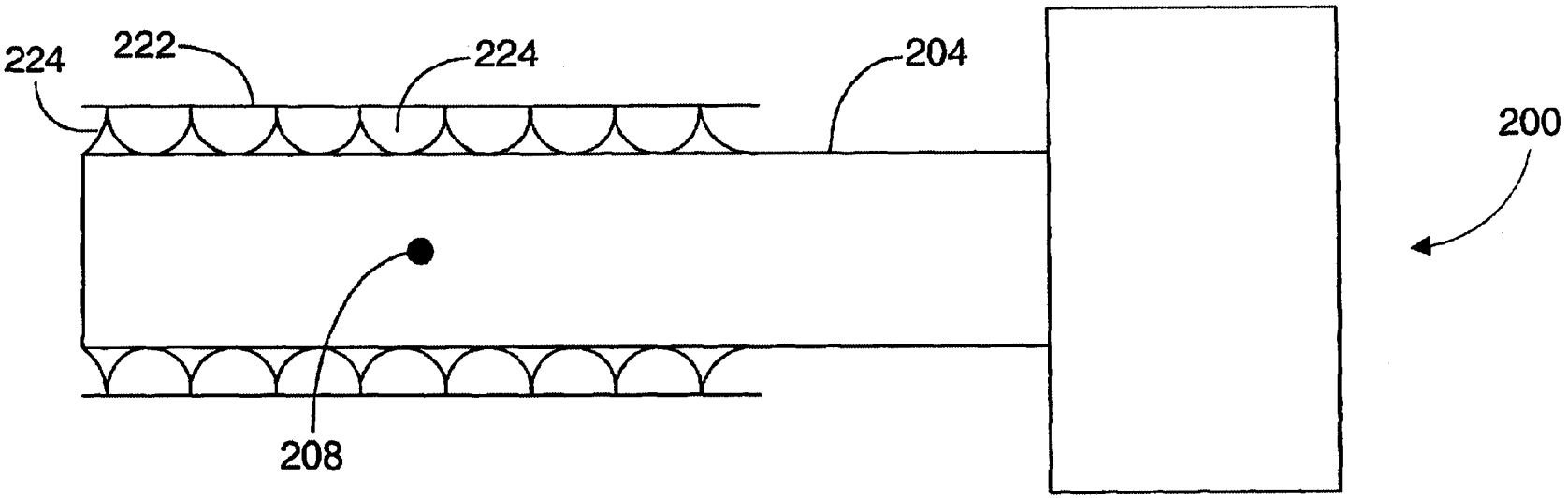
FIG. 21 depicts an impact instrument with a grasping member having a substantially rigid outer surface.

In an embodiment, the member which the user grasps is generally loosely coupled to the elongated member (e.g., shank) of the impact instrument in some manner. FIG. 21 illustrates an embodiment in which most of grasping member is loosely coupled to the elongated member. In the embodiment the striking instrument would still tend to pivot about its ideal pivot point, however the amount of pivot would generally be less than with respect to other embodiments described herein. That is, the performance is less in this instrument. It should be noted that the embodiment depicted in FIG. 21 includes a grasping member that has a substantially rigid exterior surface 222 with a compressible (e.g., "spongy") material between it and the elongated member.

The hand tends to involuntarily flex during impact for ordinary impact instruments. The hand preferably does not involuntarily flex, or flexes much less than with ordinary impact devices, during impact when using an embodiment of this invention. Such an impact instrument has less of a tendency to cause a user to feel that the instrument is going to jump out of the hand during impact, so the hand does not try to compensate and flex to hold the instrument more tightly. The physiological reason for such is not completely understood, but the end result is that the user tends to feel noticeably more comfort and significantly less fatigue during use.

It is believed that the ideal pivot point is preferably located in the grasping region of the grasping member. The grasping region, however, is not normally at the end of the elongated member since it is somewhat more difficult for a user to maintain a grip onto the elongated member if the user is only grasping it at its end. The maximum striking efficiency (i.e., maximum force per input of energy from the user), however, occurs when and if the user grasps the elongated member at its end that is distant from the impact surface. More leverage (i.e., more moment force) can be applied to the impact surface when the user grasps at or nearer to this end of the elongated member. As such, professional framers will tend to grasp a hammer at or near to the very end of the shank in order to get more leverage and drive nails faster (such a grasp is partially depicted in FIG. 1 in that the hand is grasping the hammer at a location nearer to the end of the shank than the ideal pivot point). Professional baseball players will likewise tend to grasp a baseball bat at the extreme end of the handle while hitting. Nonprofessional framers and nonprofessional baseball players, however, need additional control so they will tend to grasp the instrument much higher up on the handle.

It is believed that the professional framer tends to develop tennis elbow and experience more fatigue than they should because their hand is not located close to the ideal pivot point, and because their hand is an extended pivot. The professional baseball player, however, does not have this problem. Since a baseball bat is not designed to strike at a particular point on the bat (as a hammer is), moving one's hands to the very end of the bat moves the "sweet spot" down towards the very end of the bat too. An advantage for the professional baseball player is that the distance that the sweet spot moves is much less than the distance the hands move, so the baseball player has, in effect, increased the length of the baseball bat when he moves his hands "down" towards the knob at the end of the bat.

An average user gains an increase in momentum transfer by using a striking instrument. It is believed that an impact instrument which is swung and does not ordinarily pivot at the extreme butt end of the elongated member can be improved upon. The improvement in impulse transfer is approximately proportional to the increase in moment length.

In an embodiment, a grasping member that pivots during use is advantageous because it focuses or concentrates the grip of the user in or about the region of the ideal pivot point during use. Thus, no matter where the user grasps the hammer, it will tend to pivot at or about the same region, and that same region is in or about the region of the ideal pivot point. Moreover, the ideal pivot point can be varied by adjusting the mass distribution, physical characteristics, etc. of the impact instrument. Thus it is possible to choose where the ideal pivot point is to be located in the impact instrument.

Preferably the ideal pivot point is located at a point wherein the momentum transfer to the impact surface is improved and/or optimized. In some embodiments the ideal pivot point may be at or close to the butt end of the elongated member of the instrument, thereby lengthening and/or maximizing the moment for a given mass and length of the elongated member. Such an instrument will have the ability to impart greater momentum transfer to the object being struck, per unit of perceived effort applied by the user to the instrument, than an instrument with the same mass (but not mass distribution) and length. Stated another way, moving the ideal pivot point closer to the distal or butt end of the elongated member tends to increase the effective length of the elongated member. Therefore the hammering power of the instrument has been increased, assuming the same amount of hammering effort is utilized.

By way of example, a hammer with an ideal pivot point located near the "butt" end of the elongated member of the hammer (i.e., located near the end of the handle of the hammer) may be compared with a hammer that does not pivot but still has the same mass and other dimensions. When both hammers are swung with equal effort, immediately before impact each hammer will have the same amount of kinetic energy. Assuming that the impact is elastic (a similar analysis is true with respect to an inelastic target), then, during and immediately after impact the grasping member of the pivoting hammer will pivot. Since momentum transfer (or leverage) is a function of the mass and the length of the moment arm, the hammer with the ideal pivot point moved closer to the butt end of the elongated member will have a longer effective moment arm. So this hammer will be able to apply more momentum transfer to the impact surface per unit of energy applied by the user to the hammer.

In the embodiments described herein, an impact instrument is often described as pivoting about a certain point. It is to be understood that the same concepts apply with respect to two handed impact instruments such as axes, golf clubs, baseball bats, etc. Although such impact instruments are intended to be grasped with two hands, they nevertheless typically tend to pivot at only one of the hands during use.

Terms such as center of percussion, radius of gyration, and ideal pivot point generally only apply, in the theoretical sense, to a rigid body. In reality few objects are completely rigid bodies. For instance, a golf club shaft bends during swinging and during impact. Even the shank and the claws of a claw hammer deform during impact. Thus most of the embodiments depicted in the figures are not, in the strict theoretical sense, rigid bodies. In a theoretical sense, a rigid body cannot vibrate. Because nearly all impact instruments are significantly stiff, rigid body calculations and equations are still approximately accurate.

Referring to FIG. 3, there is some pivoting action between the grasping member and the shank of the instrument. The amount of pivot depends on the stiffness of the grasping member/shank combination and the magnitude of impact. The entire instrument may be modeled as a single rigid body or as two rigid bodies. In the case wherein there is a very loose pivot and/or a very large impact, the grasping member and the rest of the instrument are not strongly coupled. Thus, calculation of the center of mass, the radius of gyration, the center of percussion, and the ideal pivot point are properly calculated by disregarding the grasping member. In the case in which the pivot is very stiff and the impact is small, the entire instrument is reasonably approximated as a rigid body. In this approximation, the instrument acts similarly to an unpivoted impact instrument, and therefore has similar performance also.

The calculation for the ideal pivot point is somewhere in between the above two cases. For the case in which the mass of the grasping member is small compared to that of the instrument, the position of the ideal pivot point is virtually constant, regardless of the pivot stiffness or impact magnitude.

There is a simple method to empirically determine or approximate the ideal pivot point in an impact instrument. In the case of a hammer, one may grasp the shank of a hammer with the thumb and forefinger and lift the head of the hammer with the other hand and drop the head of the hammer a few inches onto a hard surface, e.g., an anvil or a concrete floor. During impact, one should notice the shock and vibration felt in the thumb and forefinger during impact. This procedure may be repeated several times, moving the thumb and forefinger up and down the shaft. With the exception of some very poorly designed instruments, at some point in the shaft there is minimal shock and vibration. That point is the ideal pivot point.

The method for determining the ideal pivot point is different than determining the "sweet spot," in, for example, a baseball bat. With a baseball bat, the bat may be grasped at a single point (e.g., the butt end) and hung like a pendulum so that it is able to be easily pivoted. Then the bat may be lightly and repeatedly tapped with the same amount of impulse along the main (longitudinal) axis, i.e up and down the bat. There will be a point in the bat at which it will react more strongly to the impulse (i.e. swing with greater amplitude). This is the "sweet spot" or the center of percussion of the bat. If the bat is grasped at a single point and strikes an object, i.e. a ball, at the sweet spot, there will not only be optimal impulse transfer to the ball, but there will be minimal shock and vibration at the pivot point.

The sweet spot and ideal pivot points are technically only single points and are dependent on the instrument being pivoted at a single point and striking an object at a single point. Such is not the case with real instruments. For instance, a 16 ounce claw hammer has an impact surface that tends to be approximately 1 inch in diameter. A nail could be struck anywhere on that impact surface. Furthermore, if the hammer is striking a flat object, i.e. a board, the impact is across the entire impact surface. As such, for a hammer the ideal pivot point is, in reality, a somewhat mushy spot with width on the order of or slightly smaller than the impact surface. The ideal pivot point is generally less dramatically felt as the length of elongated member of the instrument increases. In general as the length of the instrument increases, then the importance of the placement of the pivot decreases. This is why that golf clubs, for instance, may be cut to different lengths for different users and still be effective. This also means that in an embodiment of the invention a golf club could be made such that it pivots at the very butt end, and this golf club may include minimal changes to the head of the club.

It should be noted that the cavities between the grasping member and the elongated member do not need to be annular for increased performance. Since the motion of the striking instrument is principally in one plane, the portion of the cavities which tend to more important for increased performance are those cavities that are in the plane of motion, i.e., the top and the bottom of the elongated member. Cavities on the sides of the elongated member tend to yield a comparatively smaller increase in the performance. To increase durability and allow the grasping member of the impact instrument to be better attached to the elongated member, it is possible to only have four cavities only on the top and the bottom.

Figure 17:
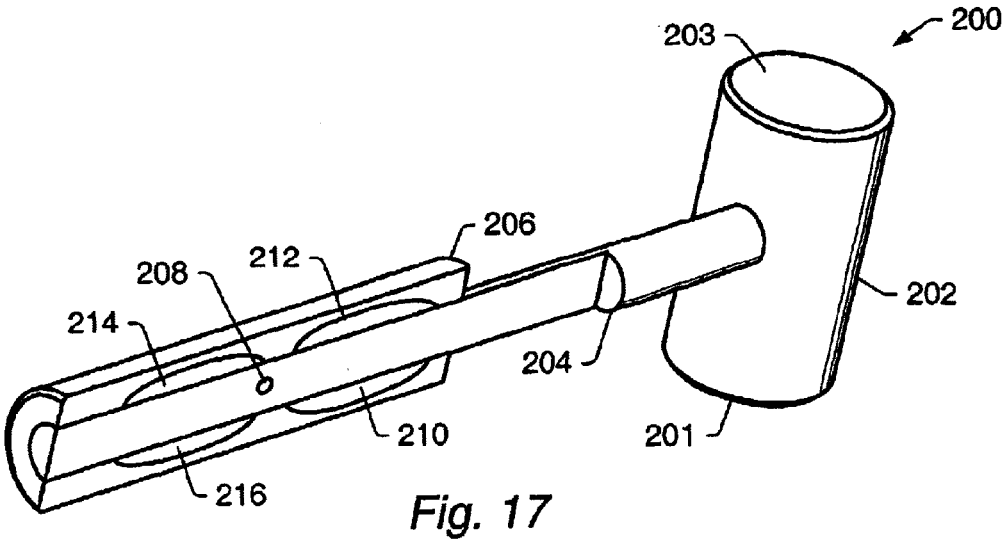
FIGS. 17, 17A and 17B depict an impact instrument with four cavities in the grasping member.
Figure 17A:
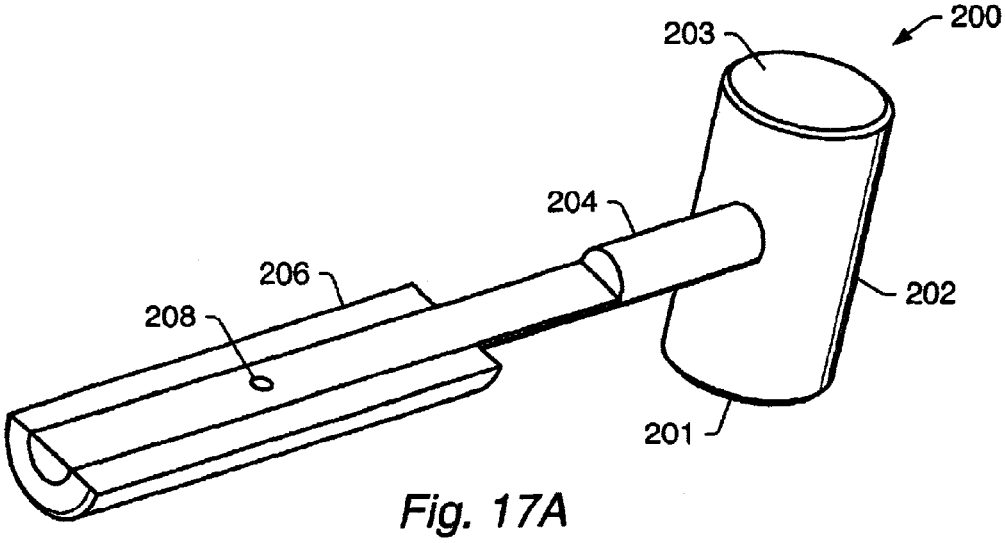
Figure 17B:
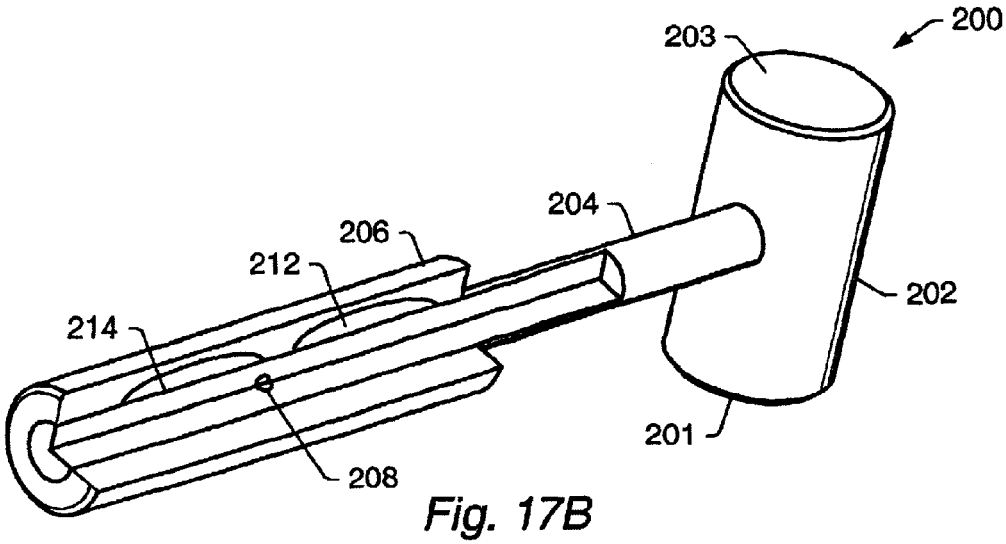

Such an impact instrument is depicted in FIGS. 17, 17A, and 17B wherein impact instrument 200 includes an impact surface 202, an elongated member 204, a grasping member 206, an ideal pivot point 208, and cavities 210, 212, 214, and 216. It is to be understood that impact instrument 200 may be a hammering device or a recreational device. The shape of the impact surface 202 will vary depending on what type of instrument the impact instrument 200 is. For instance, if the impact instrument 200 is a golf club, then impact surface 202 will be in the shape of a "wood" or an "iron". If impact instrument 200 is a hammer, the impact surface 202 will be in the shape of a hammer head with the striking surface being at location 201 and the "claw" being at location 203.

Figure 18:
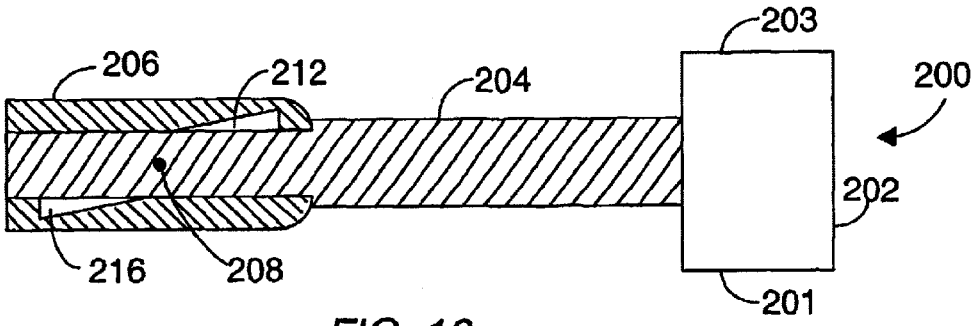
FIG. 18 depicts an impact instrument with two cavities in the grasping member.

Shock in an impact instrument such as a hammer may causes damage to the user. The vibration, or the after-ringing of the impact instrument, while somewhat annoying, is usually less damaging. Thus, in an embodiment the impact instrument may only include two of the four above-mentioned cavities since those two cavities 212 and 216 tend to be more important in addressing and lessening the shock felt by the user (see FIG. 18). During and immediately after impact, the hand and the impact instrument are counter rotating with respect to one another (the hand is still proceeding forward while the impact instrument is now rebounding backward). Consequently, the pinky and ring finger as well as the web of the hand tend to feel the majority of the shock. These portions of the hand will be proximate to (i.e. on the outside of) the cavities 212 and 216 shown in FIG. 18. Thus when the grasping member includes flexible material, then immediately after impact the flexible material will bend into the cavities 212 and 216, thus causing the grasping material and such cavities to isolate the user from and/or absorb some of the shock that would otherwise be felt by the user. In the embodiment shown in FIG. 18, only a relatively small portion of the grasping material comprises the cavities 212 and 216. Thus a larger portion of the grasping material is left in place, without cavities, thereby tending to increase the strength and durability of the grasping member, as well as the adhesiveness of the grasping member to the elongated member.

Cavities 212, 214, 216, and 218 may preferably be filled with air, or a material more compressible than the material of the grasping material. In one embodiment the material in the cavities may be a soft foam rubber or closed cell material whereas the grasping material may be a harder or stiffer rubber, a harder or stiffer plastic material, fiberglass, metal (e.g., steel), aluminum, graphite, polycarbonate, or vinyl.

Figure 19:
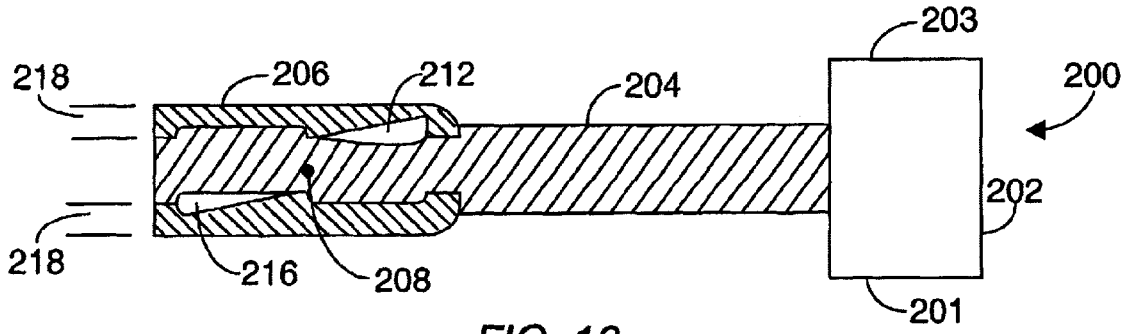
FIG. 19 depicts an impact instrument with a bent elongated member and two cavities in the grasping member.

In an embodiment (e.g., such as FIG. 20) a single cavity 220 may be used. In this embodiment, and in the embodiment shown in FIG. 19, the ideal pivot point 208 may be varied to be located further from the impact surface 202 (such variance may be achieved by varying the dimensions, shapes and/or masses of the various components in the impact instrument). As such, it is possible that only a single cavity 220 may be located on the "top" of the elongated member 204. Preferably the cavity is located such that post-impact rebound shock is isolated from the user and/or such shock is at least partially absorbed by material in the cavity and/or the material surrounded or proximate the cavity. Thus it is to be understood that the "top" of the elongated member 204 is the location of the cavities when location 201 is the impact surface of, e.g., a hammer.

Figure 20:
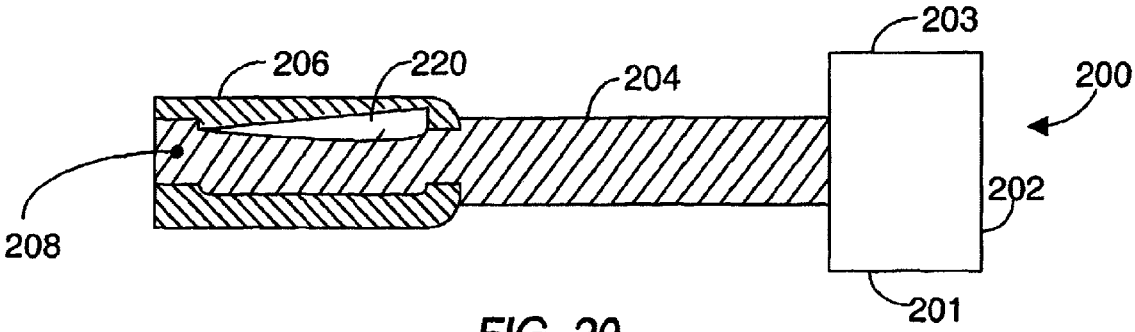
FIG. 20 depicts an impact instrument with a bent elongated member and a cavity in the grasping member.

In an embodiment such as FIG. 20 a single cavity 220 may be used. In this embodiment, and in the embodiment shown in FIG. 19, the ideal pivot point 208 may be varied to be located further from the impact surface 202 (such variance may be achieved by varying the dimensions, shapes and/or masses of the various components in the impact instrument). As such, it is possible that only a single cavity 220 may be located on the "top" of the elongated member 204. Preferably the cavity is located such that post-impact rebound shock is isolated from the user and/or such shock is at least partially absorbed by material in the cavity and/or the material surrounded or proximate the cavity. Thus it is to be understood that the "top" of the elongated member 204 is the location of the cavities when location 201 is the impact surface of, e.g., a hammer.

As shown in FIG. 21, in an embodiment an impact instrument 200 may include a substantially rigid outer surface 222. Between outer surface 222 and the elongated member 204 may be a cavity 224, which may or may not include a compressible material, air, or a combination thereof (e.g., compartments filled with air). In the context of this application a "rigid" outer surface 222 means an outer surface that is less compressible than the material in the cavity 224. The impact instrument 200 is not constrained to pivot at any single point.

An advantage of the embodiments depicted in the figures is that the instruments may typically be constructed (e.g., with cavities) such that its appearance may not be substantially different from the appearance of an ordinary instrument that does not have any features of the invention.

In an embodiment the cavities may include ribs and/or protrusions for structural support. Cavities may be joined by strips or pieces of material. Cavities may be in the form of cells of air separated from each other with pieces of material.

In an embodiment the elongated member comprises ribs and/or protrusions to enhance the fit and/or adhesion of the grasping member to the elongated member.

It is believed that when vibration dampening devices of the prior art are located proximate the impact end of an impact instrument then such devices have the effect of decreasing the shock and vibration, but this action simultaneously decreases the peak impulse that the striking instrument can deliver during use. Such vibration dampening devices may significantly decrease the effectiveness of an impact instrument, especially with respect to a hammer.

It is believed that, when a vibration dampening device of the prior art is located proximate the butt end of an impact device, then that vibration dampening device has the effect of reducing the vibration without largely reducing the impact transfer. The shock, however, is believed to cause much more damage and fatigue to the user. This shock is largely unaffected by this vibration dampening device. This is because the shock, which originates from the impact region, generally travels through the portion of the elongated member where the hand is grasping before it can be damped at the butt end.

A human hand tends to involuntarily flex, or clench, during impact while swinging an impact instrument. Shock and vibration are often perceived as being less when a user holds the instrument very tightly. A professional framer, however, tends to grasp a conventional hammer on the very butt end (in order to maximize the impulse transferred to the surface being hammered). At the butt end, the shock and vibration are generally the worst, so the framer tends to hold the handle more tightly to lessen the sting in the hand, particularly in the pinky and ring finger. Such tight holding, however, tends to increase fatigue and also transfer more of the shock to the elbow, thereby increasing the chance of developing damage to the arm or "tennis elbow." In sum, in a convention hammer maximizing impulse transfer causes more vibration and more stinging. To lessen the sting in the hand, a user such as a framer will hold a hammer more tightly, but this action causes tennis elbow to develop more readily.

Thus certain advantages of the invention are readily apparent. An impact instrument can be designed so that the hand grasps the instrument at or about the region of the ideal pivot point. The impact instrument can be designed to convert the extended pivot of the hand to a less extended pivot region. The grasping member may be designed to pivot, and such pivoting preferably occurs at or about the ideal pivot point. Energy absorbing material in cavities may be used. All of these features tend to lessen vibration and/or shock felt by the user. In addition, the effective length of the elongated member may be increased by moving the ideal pivot point to a location closer to the butt end of the impact instrument, thus increasing the amount of momentum imparted to the object being struck (assuming the mass and length of the impact instrument are the same, and assuming the same amount of energy is input into the impact instrument by the user). This effective length increase can be combined with the other above described features to optimize the characteristics of the impact instrument and to design the instrument so that the user does not have to grasp the butt end of the elongated member to have the same increased momentum transfer (but without the increased stinging or vibration) experienced by the "professional" user who is skilled enough to grasp the instrument at the butt end of the instrument.

Another advantage of an embodiment of the invention is that the instrument may be designed such that the pivot point, which preferably is located at or about the ideal pivot point, remains substantially the same for different users of the instrument. As such, the center of the preferred impact surface (which is preferably the center of percussion) will remain the same. The impact instrument may become, in effect, standardized so that different users can grasp the same elongated member at different positions on the grasping member and the device will be constrained to pivot at or about the ideal pivot point. Moreover, for instruments with larger and/or more varied impact surfaces (e.g., baseball bats, tennis rackets, etc.), the preferred impact surface remains relatively constant and is located at the position on the instrument such that maximum impulse transfer is attained. Thus the preferred impact surface can be painted or marked on the instrument. With a baseball bat, for instance, no such information could be previously provided since the sweet spot varied depending on where the bat was held.

Thus an advantage of an embodiment of the invention is that, in the case of a device in which the impact surface is reasonably well defined (e.g., a hammer or pick), it is now possible to manufacture an impact instrument such that the impact surface is at the center of percussion for all users. Different users grasp such an impact instrument at different locations along the elongated member, however the device is constrained to nevertheless pivot at a selected point (at or about the ideal pivot point).

While some of the embodiments of impact instruments described herein may only be used with one hand (e.g., hammers), it is to understood that the impact instruments of the invention will also include instruments that are intended to be held with two hands (e.g., golf clubs, baseball bats, etc.).

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims. More specifically, while many of the embodiments shown and described herein relate to hammering devices, it is to be understood that these same embodiments may also apply to other impact instruments such as recreational devices.

What is claimed is:

1. A hammering device, comprising:

a head;

a shank extending from the head and comprising a longitudinal axis;

a grasping member substantially surrounding at least a portion of the shank;

at least one cavity disposed between the grasping member and the shank;

an ideal pivot point, wherein the grasping member engages the shank proximate the ideal pivot point; and wherein the grasping member is configured to bend to alter a thickness of at least one cavity during use.

2. The hammering device of claim 1, wherein the head comprises an impact surface configured to deliver an impulse from the hammering device to an object during use, and wherein bending of the grasping member increases the delivered impulse during use.

3. The hammering device of claim 1, further comprising a compressible material disposed in at least one cavity.

4. The hammering device of claim 3, wherein the compressible material is configured to dampen vibrations through the hammering device during use.

5. The hammering device of claim 1, wherein bending of the grasping member occurs proximate the ideal pivot point of the device during use.

6. The hammering device of claim 1, wherein the grasping member is configured to bend to reduce counter-rotational forces imparted from the hammering device during use.

7. The hammering device of claim 1, wherein the head comprises an impact surface configured to deliver an impulse from the hammering device to an object during use, wherein the grasping member bends to increase the delivered impulse, and wherein a compressible material disposed in at least one cavity is configured to dampen vibrations through the hammering device during use.

8. The hammering device of claim 1, wherein the grasping member comprises a first end and a second end located opposite the first end, and wherein the grasping member is disposed over the ideal pivot point such that the ideal pivot point lies substantially midway between the first end and the second end.

9. The hammering device of claim 1, wherein at least one cavity comprises a thickness that varies along the longitudinal axis of the shank.

10. The hammering device of claim 1, wherein the head comprises an impact surface configured to deliver an impulse from the hammering device to an object during use, wherein at least one cavity comprises a thickness that varies along the longitudinal axis of the shank, and wherein the thickness varies as a function of a magnitude of the delivered impulse during use.

11. A hammering device, comprising:

a head;

a shank extending from the head and comprising a longitudinal axis;

a grasping member substantially surrounding at least a portion of the shank;

at least one cavity disposed between the grasping member and the shank;

an ideal pivot point;

wherein the grasping member is configured to bend proximate the ideal pivot point to alter a thickness of at least one cavity during use.

12. The hammering device of claim 11, wherein the head comprises an impact surface configured to deliver an impulse from the hammering device to an object during use, and wherein bending of the grasping member increases the delivered impulse during use.

13. The hammering device of claim 11, further comprising a compressible material disposed in at least one cavity.

14. The hammering device of claim 13, wherein the compressible material is configured to dampen vibrations through the hammering device during use.

15. The hammering device of claim 11, wherein the grasping member is configured to bend to reduce counter-rotational forces imparted from the hammering device during use.

16. The hammering device of claim 11, wherein the head comprises an impact surface configured to deliver an impulse from the hammering device to an object during use, wherein the grasping member bends to increase the delivered impulse, and wherein a compressible material disposed in at least one cavity is configured to dampen vibrations through the hammering device during use.

17. The hammering device of claim 11, wherein the grasping member comprises a first end and a second end located opposite the first end, and wherein the grasping member is disposed over the ideal pivot point such that the ideal pivot point lies substantially midway between the first end and the second end.

18. The hammering device of claim 11, wherein at least one cavity comprises a thickness that varies along the longitudinal axis of the shank.

19. The hammering device of claim 11, wherein the head comprises an impact surface configured to deliver an impulse from the hammering device to an object during use, wherein at least one cavity comprises a thickness that varies along the longitudinal axis of the shank, and wherein the thickness varies as a function of a magnitude of the delivered impulse during use.

20. A hammering device, comprising:

a head;

a shank extending from the head and comprising a longitudinal axis;

a grasping member substantially surrounding at least a portion of the shank, wherein the grasping member comprises a first end and a second end located opposite the first end;

at least one cavity disposed between the grasping member and the shank;

an ideal pivot point, wherein the grasping member engages the shank at the ideal pivot point, and wherein the ideal pivot point is located substantially midway between the first end and the second end of the grasping member; and wherein the grasping member is configured to bend to alter a thickness of at least one cavity during use.

21. The hammering device of claim 20, wherein the head comprises an impact surface configured to deliver an impulse from the hammering device to an object during use, and wherein bending of the grasping member increases the delivered impulse during use.

22. The hammering device of claim 20, further comprising a compressible material disposed in at least one cavity.

23. The hammering device of claim 22, wherein the compressible material is configured to dampen vibrations through the hammering device during use.

24. The hammering device of claim 20, wherein the grasping member is configured to bend to reduce counter-rotational forces imparted from the hammering device during use.

25. The hammering device of claim 20, wherein the head comprises an impact surface configured to deliver an impulse from the hammering device to an object during use, wherein the grasping member bends to increase the delivered impulse, and wherein a compressible material disposed in at least one cavity is configured to dampen vibrations through the hammering device during use.

26. The hammering device of claim 20, wherein at least one cavity comprises a thickness that varies along the longitudinal axis of the shank.

27. The hammering device of claim 20, wherein the head comprises an impact surface configured to deliver an impulse from the hammering device to an object during use, wherein at least one cavity comprises a thickness that varies along the longitudinal axis of the shank, and wherein the thickness varies as a function of a magnitude of the delivered impulse during use.

28. A hammering device, comprising:

a head having an impact surface;

a shank extending from the head and comprising a longitudinal axis;

a grasping member substantially surrounding at least a portion of the shank;

at least one cavity disposed between the grasping member and the shank;

at least one point of engagement between the grasping member and the shank;

an ideal pivot point, wherein the grasping member engages the shank proximate the ideal pivot point of the device during use; and wherein the grasping member is configured to bend between at least one point of engagement and an end of the grasping member to alter a thickness of at least one cavity during use.

29. The hammering device of claim 28, wherein the impact surface is configured to deliver an impulse from the hammering device to an object during use, and wherein bending of the grasping member increases the delivered impulse during use.

30. The hammering device of claim 28, further comprising a compressible material disposed in at least one cavity.

31. The hammering device of claim 28, further comprising a compressible material disposed in at least one cavity, wherein the compressible material is configured to dampen vibrations through the hammering device during use.

32. The hammering device of claim 28, wherein bending of the grasping member occurs proximate the ideal pivot point of the device during use.

33. The hammering device of claim 28, wherein the grasping member is configured to bend to reduce counter-rotational forces imparted from the hammering device during use.

34. The hammering device of claim 28, wherein the grasping member comprises a first end and a second end located opposite the first end, and wherein the grasping member is disposed over the ideal pivot point such that the ideal pivot point lies substantially midway between the first end and the second end.

35. The hammering device of claim 28, wherein the impact surface is configured to deliver an impulse from the hammering device to an object during use, wherein at least one cavity comprises a thickness that varies along the longitudinal axis of the shank, and wherein the thickness varies as a function of a magnitude of the delivered impulse during use.

36. The hammering device of claim 28, wherein the grasping member is configured to reduce shock forces felt by the user from the elongated member during use.

37. The hammering device of claim 28, further comprising a compressible material disposed within at least one cavity, wherein the grasping member comprises a compressible material, and wherein the compressible material of the grasping member is less compressible than the compressible material disposed within at least one cavity.

38. The hammering device of claim 28, wherein the grasping member comprises a surface of increased friction for grasping by the user.

39. The hammering device of claim 28, wherein at least one cavity is configured to reduce shock forces felt by the user from the elongated member during use.

40. The hammering device of claim 28, further comprising a compressible material disposed in at least one cavity, wherein the compressible material comprises air.

41. The hammering device of claim 28, further comprising a compressible compartment filled with air disposed within at least one cavity.

42. A hammering device, comprising:

a head having an impact surface;

a shank extending from the head and comprising a longitudinal axis;

a grasping member substantially surrounding at least a portion of the shank;

at least one cavity disposed between the grasping member and the shank;

an ideal pivot point, wherein the grasping member engages the shank proximate the ideal pivot point of the device during use; and wherein the grasping member is configured to bend proximate the ideal pivot point during use.

43. The hammering device of claim 42, wherein the impact surface is configured to deliver an impulse from the hammering device to an object during use, and wherein bending of the grasping member increases the delivered impulse during use.

44. The hammering device of claim 42, further comprising a compressible material disposed in at least one cavity.

45. The hammering device of claim 42, further comprising a compressible material disposed in at least one cavity, wherein the compressible material is configured to dampen vibrations through the hammering device during use.

46. The hammering device of claim 42, wherein the grasping member engages the shank proximate the ideal pivot point of the device during use.

47. The hammering device of claim 42, wherein the grasping member is configured to bend to reduce counter-rotational forces imparted from the hammering device during use.

48. The hammering device of claim 42, wherein the grasping member comprises a first end and a second end located opposite the first end, and wherein the grasping member is disposed over the ideal pivot point such that the ideal pivot point lies substantially midway between the first end and the second end.

49. The hammering device of claim 42, wherein the impact surface is configured to deliver an impulse from the hammering device to an object during use, wherein at least one cavity comprises a thickness that varies along the longitudinal axis of the shank, and wherein the thickness varies as a function of a magnitude of the delivered impulse during use.

50. The hammering device of claim 42, wherein the grasping member is configured to reduce shock forces felt by the user from the elongated member during use.

51. The hammering device of claim 42, further comprising a compressible material disposed within at least one cavity, wherein the grasping member comprises a compressible material, and wherein the compressible material of the grasping member is less compressible than the compressible material disposed within at least one cavity.

52. The hammering device of claim 42, wherein the grasping member comprises a surface of increased friction for grasping by the user.

53. The hammering device of claim 42, wherein at least one cavity is configured to reduce shock forces felt by the user from the elongated member during use.

54. The hammering device of claim 42, further comprising a compressible material disposed in at least one cavity, wherein the compressible material comprises air.

55. The hammering device of claim 42, further comprising a compressible compartment filled with air disposed within at least one cavity.

56. A hammering device, comprising:

a head having an impact surface;

a shank extending from the head and comprising a longitudinal axis;

a grasping member substantially surrounding at least a portion of the shank;

at least one cavity disposed between the grasping member and the shank;

at least one point of engagement between the grasping member and the shank;

an ideal pivot point, wherein the grasping member comprises a first end and a second end located opposite the first end, and wherein the grasping member is disposed over the ideal pivot point such that the ideal pivot point lies substantially midway between the first end and the second end; and wherein the grasping member is configured to bend between at least one point of engagement and an end of the grasping member to alter a thickness of at least one cavity during use.

57. The hammering device of claim 56, wherein the impact surface is configured to deliver an impulse from the hammering device to an object during use, and wherein bending of the grasping member increases the delivered impulse during use.

58. The hammering device of claim 56, further comprising a compressible material disposed in at least one cavity.

59. The hammering device of claim 56, further comprising a compressible material disposed in at least one cavity, wherein the compressible material is configured to dampen vibrations through the hammering device during use.

60. The hammering device of claim 56, wherein bending of the grasping member occurs proximate the ideal pivot point of the device during use.

61. The hammering device of claim 56, wherein the grasping member is configured to bend to reduce counter-rotational forces imparted from the hammering device during use.

62. The hammering device of claim 56, wherein the grasping member engages the shank proximate the ideal pivot point of the device during use.

63. The hammering device of claim 56, wherein the impact surface is configured to deliver an impulse from the hammering device to an object during use, wherein at least one cavity comprises a thickness that varies along the longitudinal axis of the shank, and wherein the thickness varies as a function of a magnitude of the delivered impulse during use.

64. The hammering device of claim 56, wherein the grasping member is configured to reduce shock forces felt by the user from the elongated member during use.

65. The hammering device of claim 56, further comprising a compressible material disposed within at least one cavity, wherein the grasping member comprises a compressible material, and wherein the compressible material of the grasping member is less compressible than the compressible material disposed within at least one cavity.

66. The hammering device of claim 56, wherein the grasping member comprises a surface of increased friction for grasping by the user.

67. The hammering device of claim 56, wherein at least one cavity is configured to reduce shock forces felt by the user from the elongated member during use.

68. The hammering device of claim 56, further comprising a compressible material disposed in at least one cavity, wherein the compressible material comprises air.

69. The hammering device of claim 56, further comprising a compressible compartment filled with air disposed within at least one cavity.

70. A hammering device, comprising:

ahead;

a shank extending from the head and comprising a longitudinal axis;

a grasping member substantially surrounding at least a portion of the shank, wherein the grasping member comprises a first end and a second end located opposite the first end;

at least one cavity disposed between the grasping member and the shank;

an ideal pivot point, wherein the grasping member is disposed over the ideal pivot point such that the ideal pivot point lies substantially midway between the first end and the second end; and wherein the grasping member is configured to alter a thickness of at least one cavity during use.

71. The hammering device of claim 70, wherein the head comprises an impact surface configured to deliver an impulse from the hammering device to an object during use, and wherein bending of the grasping member increases the delivered impulse during use.

72. The hammering device of claim 70, further comprising a compressible material disposed in at least one cavity.

73. The hammering device of claim 70, wherein the compressible material is configured to dampen vibrations through the hammering device during use.

74. The hammering device of claim 70, wherein the grasping member is configured to bend to reduce counter-rotational forces imparted from the hammering device during use.

75. The hammering device of claim 70, wherein the head comprises an impact surface configured to deliver an impulse from the hammering device to an object during use, wherein the grasping member bends to increase the delivered impulse, and wherein a compressible material disposed in the cavity is configured to dampen vibrations through the hammering device during use.

76. The hammering device of claim 70, wherein at least one cavity comprises a thickness that varies along the longitudinal axis of the shank.

77. The hammering device of claim 70, wherein the head comprises an impact surface configured to deliver an impulse from the hammering device to an object during use, wherein at least one cavity comprises a thickness that varies along the longitudinal axis of the shank, and wherein the thickness varies as a function of a magnitude of the delivered impulse during use.

78. The hammering device of claim 70, wherein the grasping member is configured to reduce shock forces felt by the user from the elongated member during use.

79. The hammering device of claim 70, further comprising a compressible material disposed within at least one cavity, wherein the grasping member comprises a compressible material, and wherein the compressible material of the grasping member is less compressible than the compressible material disposed within at least one cavity.

80. The hammering device of claim 70, wherein the grasping member comprises a surface of increased friction for grasping by the user.

81. The hammering device of claim 70, wherein at least one cavity is configured to reduce shock forces felt by the user from the elongated member during use.

82. The hammering device of claim 70, further comprising a compressible material disposed in at least one cavity, wherein the compressible material comprises air.

83. The hammering device of claim 70, further comprising a compressible compartment filled with air disposed within at least one cavity.

84. A hammering device, comprising:

a head;

a shank extending from the head and comprising a longitudinal axis;

a grasping member substantially surrounding at least a portion of the shank;

at least one cavity disposed between the grasping member and the shank;

an ideal pivot point; and wherein the grasping member is configured to alter a thickness of at least one cavity during use wherein bending of the grasping member occurs proximate the ideal pivot point of the device during use.

85. The hammering device of claim 84, wherein the head comprises an impact surface configured to deliver an impulse from the hammering device to an object during use, and wherein bending of the grasping member increases the delivered impulse during use.

86. The hammering device of claim 84, further comprising a compressible material disposed in at least one cavity.

87. The hammering device of claim 86, wherein the compressible material is configured to dampen vibrations through the hammering device during use.

88. The hammering device of claim 84, wherein the grasping member is configured to bend to reduce counter-rotational forces imparted from the hammering device during use.

89. The hammering device of claim 84, wherein the head comprises an impact surface configured to deliver an impulse from the hammering device to an object during use, wherein the grasping member bends to increase the delivered impulse, and wherein a compressible material disposed in the cavity is configured to dampen vibrations through the hammering device during use.

90. The hammering device of claim 84, wherein at least one cavity comprises a thickness that varies along the longitudinal axis of the shank.

91. The hammering device of claim 84, wherein the head comprises an impact surface configured to deliver an impulse from the hammering device to an object during use, wherein at least one cavity comprises a thickness that varies along the longitudinal axis of the shank, and wherein the thickness varies as a function of a magnitude of the delivered impulse during use.

92. The hammering device of claim 84, wherein the grasping member is configured to reduce shock forces felt by the user from the elongated member during use.

93. The hammering device of claim 84, further comprising a compressible material disposed within at least one cavity, wherein the grasping member comprises a compressible material, and wherein the compressible material of the grasping member is less compressible than the compressible material disposed within at least one cavity.

94. The hammering device of claim 84, wherein the grasping member comprises a surface of increased friction for grasping by the user.

95. The hammering device of claim 84, wherein at least one cavity is configured to reduce shock forces felt by the user from the elongated member during use.

96. The hammering device of claim 84, further comprising a compressible material disposed in at least one cavity, wherein the compressible material comprises air.

97. The hammering device of claim 84, further comprising a compressible compartment filled with air disposed within at least one cavity.

98. The hammering device of claim 84, wherein the grasping member comprises a first located opposite the first end, and wherein the grasping member is disposed over the ideal pivot point such that the ideal pivot point lies substantially midway between the first end and the second end.

99. A hammering device, comprising:

a head;

a shank extending from the head and comprising a longitudinal axis;

a grasping member substantially surrounding at least a portion of the shank;

at least one cavity disposed between the grasping member and the shank;

an ideal pivot point, wherein the grasping member engages the shank proximate the ideal pivot point of the device during use; and wherein the grasping member is configured to alter a thickness of at least one cavity during use.

100. The hammering device of claim 99, wherein the head comprises an impact surface configured to deliver an impulse from the hammering device to an object during use, and wherein bending of the grasping member increases the delivered impulse during use.

101. The hammering device of claim 99, further comprising a compressible material disposed in at least one cavity.

102. The hammering device of claim 101, wherein the compressible material is configured to dampen vibrations through the hammering device during use.

103. The hammering device of claim 99, wherein the grasping member is configured to bend to reduce counter-rotational forces imparted from the hammering device during use.

104. The hammering device of claim 99, wherein the head comprises an impact surface configured to deliver an impulse from the hammering device to an object during use, wherein the grasping member bends to increase the delivered impulse, and wherein a compressible material disposed in the cavity is configured to dampen vibrations through the hammering device during use.

105. The hammering device of claim 99, wherein at least one cavity comprises a thickness that varies along the longitudinal axis of the shank.

106. The hammering device of claim 99, wherein the head comprises an impact surface configured to deliver an impulse from the hammering device to an object during use, wherein at least one cavity comprises a thickness that varies along the longitudinal axis of the shank, and wherein the thickness varies as a function of a magnitude of the delivered impulse during use.

107. The hammering device of claim 99, wherein the grasping member is configured to reduce shock forces felt by the user from the elongated member during use.

108. The hammering device of claim 99, further comprising a compressible material disposed within at least one cavity, wherein the grasping member comprises a compressible material, and wherein the compressible material of the grasping member is less compressible than the compressible material disposed within at least one cavity.

109. The hammering device of claim 99, wherein the grasping member comprises a surface of increased friction for grasping by the user.

110. The hammering device of claim 99, wherein at least one cavity is configured to reduce shock forces felt by the user from the elongated member during use.

111. The hammering device of claim 99, further comprising a compressible material disposed in at least one cavity, wherein the compressible material comprises air.

112. The hammering device of claim 99, further comprising a compressible compartment filled with air disposed within at least one cavity.

113. The hammering device of claim 99, wherein the grasping member comprises a first end and a second end located opposite the first end, and wherein the grasping member is disposed over the ideal pivot point such that the ideal pivot point lies substantially midway between the first end and the second end.

114. The hammering device of claim 11, further comprising a compressible material disposed in at least one cavity, wherein at least one cavity is configured to reduce shock forces felt by the user from the elongated member during use.

115. The hammering device of claim 11, wherein the grasping member is configured to bend to reduce counter-rotational forces imparted from the hammering device during use and reduce shock forces felt by the user from the elongated member during use.

116. The hammering device of claim 11, wherein at least one cavity comprises a thickness that varies along the longitudinal axis of the shank and a compressible material disposed in at least one cavity.

117. The hammering device of claim 11, wherein the grasping member comprises a surface of increased friction for grasping by the user, and wherein the grasping member is configured to reduce shock forces felt by the user from the elongated member during use.

118. The hammering device of claim 11, wherein the grasping member comprises a first end and a second end located opposite the first end, and wherein the grasping member is disposed over the ideal pivot point such that the ideal pivot point lies substantially midway between the first end and the second end, and wherein the grasping member comprises a surface of increased friction for grasping by the user.

119. The hammering device of claim 11, wherein the head comprises an impact surface configured to deliver an impulse from the hammering device to an object during use, wherein at least one cavity comprises a compressible compartment filled with air, wherein the compressible compartment comprises a thickness that varies along the longitudinal axis of the shank, and wherein the thickness varies as a function of a magnitude of the delivered impulse during use.

120. The hammering device of claim 11, further comprising a compressible compartment filled with air disposed within at least one cavity, wherein the grasping member comprises a compressible material, and wherein the compressible material of the grasping member is less compressible than the compressible compartment disposed within at least one cavity.

121. The hammering device of claim 11, further comprising a compressible material disposed within at least one cavity, wherein the grasping member comprises a compressible material configured to reduce shock forces, and wherein the compressible material of the grasping member is less compressible than the compressible material disposed within at least one cavity.

122. The hammering device of claim 11, further comprising a compressible material disposed in at least one cavity, wherein the compressible material comprises air, and wherein the compressible material is configured to dampen vibrations through the hammering device during use.

123. The hammering device of claim 11, further comprising a compressible material disposed in at least one cavity, and wherein the compressible material is configured to dampen vibrations through the hammering device during use.

124. The hammering device of claim 11, wherein the grasping member is configured to bend to reduce shock forces and counter-rotational forces imparted from the hammering device during use.

125. The hammering device of claim 11, wherein the grasping member comprises a first end and a second end located opposite the first end, and wherein the grasping member is disposed over the ideal pivot point such that the ideal pivot point lies substantially midway between the first end and the second end, and wherein the grasping member is configured to reduce shock forces felt by the user from the elongated member during use.

126. The hammering device of claim 11, further comprising a compressible compartment filled with air disposed within at least one cavity, wherein the compressible compartment is configured to reduce shock forces felt by the user from the elongated member during use.

127. The hammering device of claim 11, wherein the head comprises an impact surface configured to deliver an impulse from the hammering device to an object during use, wherein the grasping member bends to increase the delivered impulse, wherein a compressible material disposed in the cavity is configured to dampen vibrations through the hammering device during use, and wherein the cavity comprises a thickness that varies along the longitudinal axis of the shank.

128. The hammering device of claim 11, wherein the at least one cavity comprises one cavity, and a compressible material disposed in the one cavity.

129. The hammering device of claim 11, wherein the at least one cavity comprises two cavities, and a compressible material disposed in at least one of the cavities.

130. The hammering device of claim 11, wherein the at least one cavity comprises at least two cavities, and a compressible material disposed in at least one of the cavities.

131. The hammering device of claim 11, wherein the grasping member is configured to bend to reduce counter-rotational forces imparted from the hammering device during use, wherein the grasping member is configured to reduce shock forces felt by the user from the elongated member during use, and wherein the grasping member comprises a surface of increased friction for grasping by the user.

132. The hammering device of claim 11, further comprising a compressible material disposed within at least one cavity, wherein the compressible material within at least one cavity comprises air, wherein the grasping member comprises a compressible material, and wherein the compressible material of the grasping member is less compressible than the compressible material disposed within at least one cavity.

* * * * *